US008708333B2

(12) United States Patent
Shiohara

(10) Patent No.: US 8,708,333 B2
(45) Date of Patent: Apr. 29, 2014

(54) MEDIUM FEEDING DEVICE AND RECORDING APPARATUS

(71) Applicant: Seiko Epson Corporation, Tokyo (JP)

(72) Inventor: Hiroshi Shiohara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/789,421

(22) Filed: Mar. 7, 2013

(65) Prior Publication Data

US 2013/0181391 A1 Jul. 18, 2013

Related U.S. Application Data

(63) Continuation of application No. 12/900,275, filed on Oct. 7, 2010, now Pat. No. 8,408,534.

(30) Foreign Application Priority Data

Oct. 8, 2009 (JP) ..... 2009-234083

(51) Int. Cl.
*B65H 1/00* (2006.01)

(52) U.S. Cl.
USPC ..... 271/145; 271/167

(58) Field of Classification Search
USPC ..... 271/161, 167, 168, 145, 19
See application file for complete search history.

(56) References Cited

U.S. PATENT DOCUMENTS

| | | | | |
|---|---|---|---|---|
| 7,828,285 | B2 * | 11/2010 | Chu et al. | 271/167 |
| 7,832,722 | B1 * | 11/2010 | Huang | 271/121 |
| 2009/0230608 | A1 * | 9/2009 | Kimura et al. | 271/10.01 |

FOREIGN PATENT DOCUMENTS

| | | |
|---|---|---|
| JP | 07-089625 | 4/1995 |
| JP | 10-218407 | 8/1998 |
| JP | 2006-225075 | 8/2006 |
| JP | 2007-161371 | 6/2007 |
| JP | 2008-094521 | 4/2008 |

* cited by examiner

*Primary Examiner* — Kaitlin Joerger
(74) *Attorney, Agent, or Firm* — Workman Nydegger

(57) ABSTRACT

A medium feeding device includes a first feeding unit feeds the medium to be fed to a downstream side of a feeding direction. A second feeding unit then feeds the medium to a upstream side and a downstream side on the basis of a feeding direction of the first feeding unit. A friction member is positioned opposite to the first feeding unit. A displacement member converts between a first state in which the displacement member protrudes upwardly in a stacked direction with respect to the friction member and a second state in which the displacement member retracts downwardly. The displacement member is set as the second state when one remaining sheet of the medium is fed to the downstream side by the first feeding unit, and the displacement member is set as the first state when a trailing end of the one remaining sheet passes through the friction member.

19 Claims, 17 Drawing Sheets

MEDIUM FEEDING DEVICE AND RECORDING APPARATUS

BACKGROUND

1. Technical Field

The present invention relates to a medium feeding device including a placing plane, on which a medium to be fed is placed, a first feeding unit for feeding the medium to be fed, which is placed on the placing plane, to a downstream side of a feeding direction, a second feeding unit for feeding the medium to be fed, which is fed by the first feeding unit, to an upstream side and a downstream side of the feeding direction on the basis of the feeding direction of the first feeding unit, and a friction member installed at a position on the placing plane, which is opposite to the first feeding unit, and a recording apparatus including the medium feeding device.

The recording apparatus used in herein is not limited to an ink jet printer, a wire dot printer, a laser printer, a line printer, a copy machine, and a facsimile machine.

2. Related Art

In the related art, as shown in JP-A-2008-094521, a printer serving as a recording apparatus includes a feeding device capable of feeding paper which is one example of a medium to be fed. The feeding device includes a tray serving as a placing plane, on which the paper is placed, a feed roller serving as a feeding unit, and a high-fiction member. Among them, the feeding roller is installed to feed plural sheets of paper placed on the tray one by one. In addition, the high-friction member is installed at a position on the tray which is opposite to the feeding roller. The high-friction member is configured so that the frictional coefficient $\mu 2$ between the high-friction member and the paper is higher than the coefficient $\mu 1$ between the paper and the paper which are placed on the tray. Accordingly, it is possible to reduce that plural sheets of papers are fed in overlapped bundle to the downstream side of the feeding direction by the feed roller.

However, when the paper is fed, the posture of the paper may be tilted to the feeding direction. When operation is executed to correct the posture of the paper, the paper is bent in a thickness direction of the paper. The reason is that a leading end of the paper is pressed by circumscribed portions of the pair of rollers. The posture of the leading end of the paper follows in a line direction formed by circumscribed positions of the pair of rollers. Accordingly, it is possible to correct the posture of the leading end side of the paper. In the case where the posture of the paper is tilted to the feeding direction, there is a difference between the flexure amount of the one end portion and the flexure amount of the other end portion in left and right sides of the paper in the widthwise direction.

The flexure of the paper acts on the pair of rollers to push the paper in the downstream side of the feeding direction. That is, the flexure has an effect on the feed amount of the pair of rollers. In addition, in the case where there is a difference between the flexure amount of the one end portion and the flexure amount of the other end portion, a difference may occur between the feed amount of the one end portion and the feed amount of the other end portion. Therefore, it is conceivable to eliminate the difference in the flexure amount of the paper, for example, by reversely feeding a trailing end side of the paper to the upstream side of the feeding direction. In this instance, the purpose of reserves feeding is not limited to the elimination of the flexure.

In the case where the trailing end of final one remaining sheet of paper is reversely fed, since the trailing end of the paper comes into contact with the high-friction member depending up the size of the paper, it can disturb the reverse feed.

SUMMARY

An advantage of some aspects of the invention is that it provides a medium feeding device capable of reversely feeding a medium to be fed to an upstream side of a feeding direction reliably even in case of one remaining sheet of the medium, and a recording apparatus including the medium feeding device.

According to a first aspect of the invention, a medium feeding device includes a placing plane on which a medium to be fed is placed; a first feeding unit which feeds the medium to be fed which is placed on the placing plane to a downstream side of a feeding direction; a second feeding unit which feeds the medium fed by the first feeding unit to a upstream side and a downstream side of the feeding direction on the basis of a feeding direction of the first feeding unit; a friction member which is installed at a position of the placing plane which is opposite to the first feeding unit; and a displacement member which is able to be converted between a first state in which the displacement member protrudes upwardly in a stacked direction of the medium to be fed with respect to the friction member and a second state in which the displacement member retracts downwardly in the stacked direction with respect to the friction member, wherein the displacement member is set as the second state when one remaining sheet of medium to be fed placed on the placing plane is fed to the downstream side of the feeding direction by the first feeding unit, and the displacement member is set as the first state when a tailing end, which is an upper end thereof in the feeding direction, of the one remaining sheet of medium to be fed passes through the friction member and then the medium to be fed is reversely fed to the upstream side of the feeding direction by the second feeding unit.

In accordance with the first aspect of the invention, in the case where the number of remaining sheets is plural sheets, the displacement member is in the second state. Therefore, a separation capacity can be ensured to separate the placed uppermost medium to be fed from a medium to be fed after a next stage by the friction member.

In addition, if the case where the number of remaining sheets is one sheet, it is possible to prevent the trailing end of the medium to be fed from coming into contact with the friction member when the final single sheet is reversely fed. Therefore, it is free from a risk in which the reverse feed of the medium to be fed is disturbed. That is, it can perform the reliable reverse feed.

Meanwhile, a technical significance of reversely feeding the medium to be fed, which is fed to the downstream of the feeding direction, to the upstream side of the feeding direction will be described.

For example, the reverse feed can eliminate the flexure of the medium to be fed which is produced at the time of skew removal.

The term "skew removal" used herein means that the tilted posture of the medium to be fed with respect to the feeding direction is corrected. In particular, it means that the tilted posture of the leading end, which is the downstream end of the feeding direction, of the paper with respect to a nip line is corrected. In this instance, the term "nip line" used herein means a line formed by circumscribed portions of the pair of rollers. That is, the nip line is a line formed by portions pinched by the pair of rollers.

The skew removal operation can use to a so-called "nip and release method" and a so-called "abutment method".

The term "nip and release method" used herein means the following process: the leading end of the medium to be fed is pinched by the pair of transport rollers serving as the third feeding unit at the downstream side of the feeding direction rather than the second feeding unit; the leading end side of the medium to be fed is reversely fed to the upstream side of the feeding direction by reserve rotation of the pair of transport rollers; the medium to be fed is bent between the pair of transport rollers and the pair of feed rollers serving as the second feeding unit; and the leading end of the medium to be fed is pressed at the nip line of the pair of transport rollers to render the posture of the leading end to follow the nip line. That is, it means that after the leading end of the medium to be fed is nipped by the pair of transport rollers, the leading end side of the medium to be fed is released to the upstream side of the feeding direction, so that the medium to be fed is bent to render the posture of the leading end to follow the nip line.

The term "abutment method" used herein means that the medium to be fed is fed to the downstream side of the feeding direction by the pair of feed rollers, and the leading end of the medium to be fed is pinched by the nip line of the pair of transport rollers which is in a pause state or a reversely rotating state to render the posture of the leading end to follow the nip line. That is, it means that abutment of the leading end of the medium to be fed against the pair of transport rollers causes to render the posture of the leading end to follow the nip line. In this instance, the medium to be fed is bent between the pair of feed rollers and the pair of transport rollers to render the posture of the leading end to follow the nip line.

For example, if it is configured not to reversely feed the medium to be fed after the medium to be fed is bent, the state in which the difference is produced between the flexure amount of the one end of the medium to be fed in the widthwise direction X and the flexure amount of the other end of the medium to be fed in the widthwise direction X is kept intact. Due to the flexure of the medium to be fed between the pair of feed rollers and the pair of transport rollers, the medium to be fed is pressed in the downstream side of the feeding direction by the pair of transport rollers. Accordingly, due to the difference in the flexure amounts, a difference may be produced between the transport amount of one end side in the widthwise direction X and the transport amount of the other end side in the widthwise direction X. As a result, during the feed after the skew removal, the medium to be fed may be newly tilted to the feeding direction, that is, a so-called accumulated skew may happen.

In particular, a problem likely happens in the case where a guide path of the paper from the pick-up to the pair of transport rollers is bent when seen at a lateral direction.

Accordingly, the medium to be fed is reversely fed by the second feeding unit.

As a result, after that, it can stabilize the feed precision when the medium to be fed is fed to the downstream side of the feeding direction by the second feeding unit or the like.

According to a second aspect of the invention, the friction member set forth in the first aspect protrudes upwardly in the stacked direction of the medium to be fed with respect to the placing plane.

In accordance with the second aspect of the invention, in addition to the same effect as that of the first aspect, when the final single sheet is reversely fed, it is possible to prevent the trailing end of the medium to be fed from coming into contact with a stepped portion formed by the placing plane and the friction member.

The technical significance in which the friction member protrudes upwardly with respect to the placing plane is to bring the friction member to reliably come into contact with the medium to be fed placed on the placing plane. Accordingly, when the medium to be fed is fed to the downward side of the feeding direction by the first member, the separation capacity can be stabilized to separate the uppermost medium to be fed from the medium to be fed after a next stage in the stacked direction.

In this case, when the final single sheet is reversely fed, the trailing end of the medium to be fed may be caught by the stepped portion to disturb the reverse feed. Therefore, the configuration having the displacement member is particularly effective.

According to a third aspect of the invention, a medium feeding device includes a placing plane on which a medium to be fed is placed; a first feeding unit which feeds the medium to be fed which is placed on the placing plane to a downstream side of a feeding direction; a second feeding unit which feeds the medium fed by the first feeding unit to a upstream side and a downstream side of the feeding direction on the basis of a feeding direction of the first feeding unit; a friction member which is installed at a position of the placing plane which is opposite to the first feeding unit; a displacement member which is able to be converted between a first state in which the displacement member protrudes upwardly in a stacked direction of the medium to be fed with respect to the friction member and a second state in which the displacement member retracts downwardly in the stacked direction with respect to the friction member; a first arm section having the displacement member; a second arm section which is installed at the upstream side of the feeding direction by the arm section and is able to engage with the first arm section; and a projection portion which is installed at the second arm section and is able to be converted between a third state in which the projection portion protrudes from the placing plane and a fourth state in which the projection portion retracts downwardly in the stacked direction with respect to the third state, wherein the projection portion is biased by a first biasing unit so that the projection portion is in the third state if an external force is not applied, and is in the fourth state by the weight of one sheet of medium to be fed on the projection portion; if the projection portion is in the fourth state, engagement of the second arm section and the first arm section is released; in the state in which the engagement of the second arm section and the first arm section is released, the displacement member is biased by a second biasing unit so that the displacement member is in the first state if the external force is not applied to the displacement member and the projection portion, and is in the second state by the weight of one sheet of medium to be fed on the displacement member; a biasing force generated from the second biasing unit is set to be higher than a biasing force generated from the first biasing unit, and the first arm section engages with the second arm section when the second state is converted into the first state; and if the projection portion is in the third state, the second arm section engages with the first arm section to maintain the first state of the displacement member.

An accordance with the third aspect of the invention, in addition to the same effects as those of the first or second aspect, in the case where even one sheet of medium to be fed is placed on the placing plane, the displacement member is in the second state, while the projection portion is in the fourth state, due to the weight of the medium to be fed. Accordingly, in the state before the trailing end of final single sheet of medium to be fed passes through the friction member, the displacement member can be in the second state. In addition, after the trailing end of the medium to be fed passes through the displacement member, the first arm section engages with the second arm section to keep the friction member in the first state. That is, only when the final medium to be fed is reversely fed, the displacement member can be kept in the first state.

According to a fourth aspect of the invention, an edge of the displacement member in the feeding direction, set forth in the third aspect, which is positioned at an upward side of the stacked direction extends from an upstream side rather than the upstream end of the top portion of the friction member in the feeding direction to a downstream side rather than a downstream end of the top portion of the friction member in the feeding direction; and the edge is provided with a slope portion which is inclined with respect to the placing plane, at the downstream side rather than the downstream end of the top portion of the friction member, so that the downstream end of the top portion of the friction member is positioned downward in the stacked direction with respect to the placing plane in the first state and is positioned upward in the stacked direction with respect to the top portion as proceeding to the upstream side.

An accordance with the fourth aspect of the invention, in addition to the same effect as that of the third aspect, the edge of the displacement member is installed to extend longer than the friction member in the feeding direction. In addition, the edge is installed within a range wider than the installed range of the friction member in the feeding direction. Therefore, in the state in which the medium to be fed is reversely fed and then the trailing end of the medium to be fed comes into contact with the displacement member, the trailing end of the medium to be fed cannot come into contact with the friction member. In addition, since the displacement member has the slope portion to raise the trailing end of the medium to be fed when it is reversely fed, thereby guiding the medium to be fed upwardly in the stacked direction with respect to the friction member. That is, it is possible to reliably prevent the trailing end of the medium to be fed from coming into contact with the friction member.

According to a fifth aspect of the invention, the edge set forth in the fourth aspect is provided with a flat portion at the upstream side thereof rather than the slope portion; when the displacement member is in the first state and the projection portion is in the third state, and no medium to be fed is on the displacement member of the first state, a posture of the flat portion at the edge of the displacement member is slanted with respect to the top portion of the friction member so that the upstream side of the flat portion is upward in the stacked direction rather than the downstream side; and when the medium to be fed is reversely fed by the second feeding unit and is moved onto the displacement member of the first state, and when the first arm section is displaced by the weight of the medium to be fed, the second arm section restricts displacement of the first arm section which is more than a predetermined amount, and at that time, the posture of the flat portion of the edge follows a posture of the top portion of the friction member.

The term "predetermined amount" used herein means an amount required to firmly engage the first arm section and the second arm section, and it is a very small amount.

In addition, the term "follow" used herein means that both postures are approximately identical to each other. That is, it means approximately parallel with each other. It is not necessary to be exactly parallel with each other, and it is of course to include a range of error.

An accordance with the fifth aspect of the invention, in addition to the same effect as that of the fourth aspect, when the medium to be fed is reversely fed, the first arm section can be firmly engaged with the second arm section by the weight of the medium to be fed when the trailing end of the medium to be fed comes into contact with the displacement member. That is, the displacement member can be locked in the first state.

In addition, the posture of the edge of the displacement member in the locked state is parallel with the posture of the top portion of the friction member. Therefore, it is possible to reliably prevent the trailing end of the medium to be fed from coming into contact with the friction member.

According to a sixth aspect of the invention, a recording apparatus including a medium feeding unit which feeds a medium to be recorded to a downstream side of a feeding direction; and a recording unit which records the medium to be recorded, which is fed by the medium feeding unit, by a recording head, wherein the medium feeding unit includes a medium feeding device set forth in any one of the first to fifth aspects, and the medium to be recorded is a medium to be fed.

An accordance with the sixth aspect of the invention, the medium feeding unit includes the medium feeding device according to any one of the first to fifth aspects. Therefore, the recording apparatus can obtain the same effects as any one of the first to fifth aspects.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will now be described with reference to the accompanying drawings.

Figure 1:
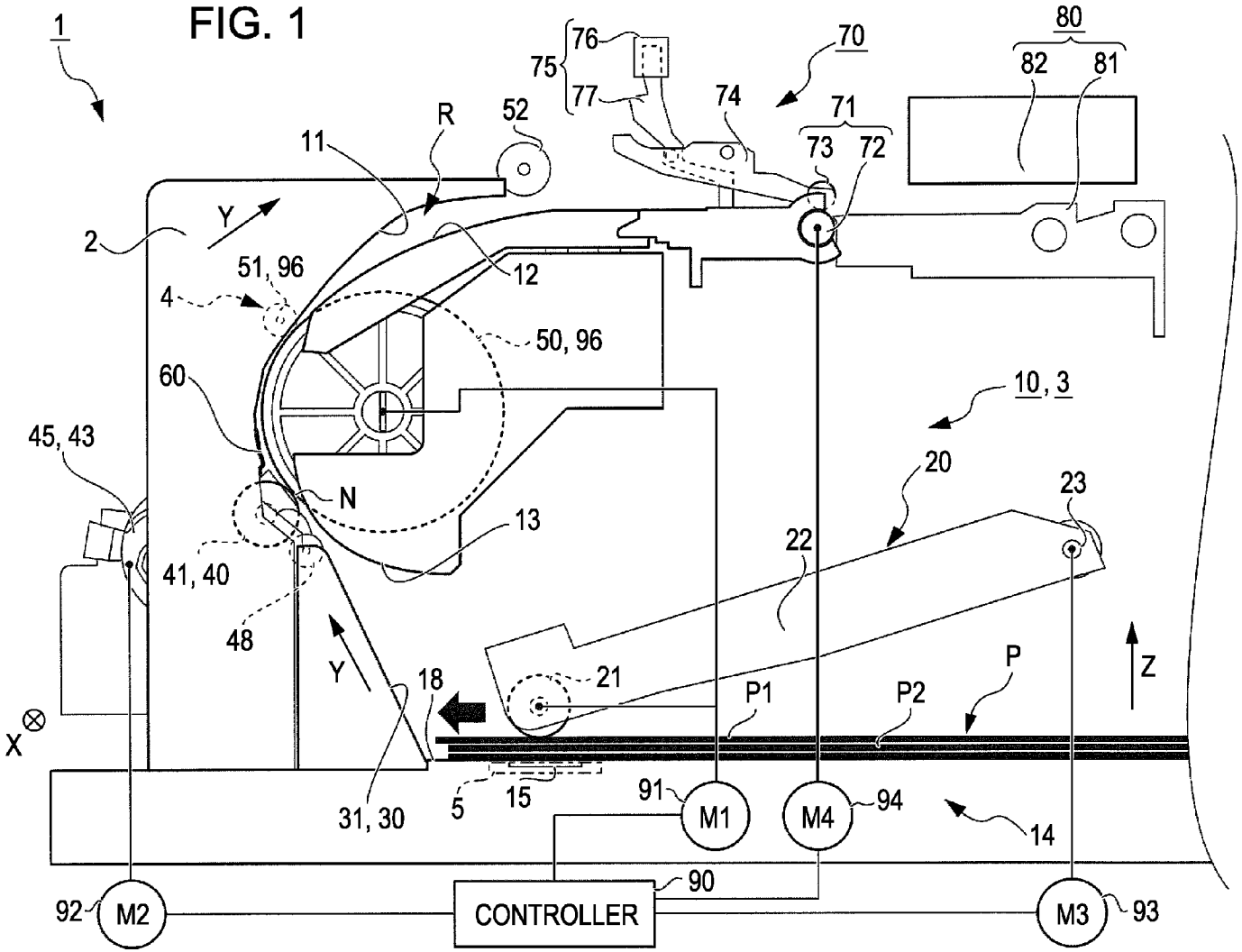
FIG. 1 is a side view illustrating a pick-up operation in an inside of a printer according to the invention.

FIG. 1 is a side view illustrating the pick-up operation in an inside of an ink jet printer (hereinafter, referred to as "printer") as an example of a recording apparatus or a liquid ejecting apparatus.

Herein, the liquid ejecting apparatus is not limited to a recording apparatus, such as an ink jet type recording apparatus, a copy machine or a facsimile machine, which executes a record on a material to be recorded by ejecting ink onto the material to be recorded, such as recording paper, from a recording head serving as a liquid ejecting head. Other examples of the liquid ejecting apparatus include an apparatus that attaches liquid for a specific application, instead of ink, to an ejecting target medium corresponding to the recording material by ejecting the liquid to the ejecting target medium from a liquid ejecting head corresponding to the recording head.

Examples of the liquid ejecting head include, in addition to the above-described recording head, a color-material ejecting head used in production of a color filter for a liquid crystal display or other apparatuses, an electrode-material (conductive paste) ejecting head used in formation of an electrode for an organic electroluminescent (EL) display, a surface emitting display (FED), or other apparatuses, a bioorganic-substance ejecting head used in production of a biochip, and a sample ejecting head as a precision pipette.

As shown in FIG. 1, a printer 1 includes a feeding unit 3 serving as a feeding device for feeding paper P, a recording unit 80, and a discharge unit (not illustrated). Among them, the feeding unit 3 has a feed section 10 and a transport unit 70. In addition, the feed section 10 includes a pick-up unit 20, a preliminary separation unit 30, and a main separation unit 40. The pick-up unit 20 is installed to pick up the paper P placed in a cassette unit 14 and then feed the paper to a downstream side of a feeding direction.

More specifically, the pick-up unit 20 includes a pick-up roller 21 driven by the power of a first motor 91 which is one example of a driving source, and an arm section 22 holding the pick-up roller 21 and swiveled around an arm shaft 23 as a fulcrum point. The pick-up roller 21 is biased by a biasing unit (not illustrated) in a direction to approaching the paper P. In addition, the arm section 22 is installed to be swiveled by a pick-up retreat unit (not illustrated), so that the pick-up roller 21 is moved in a direction spaced apart from the placed paper P, which is a so-called pick-up release operation.

In addition, the preliminary separation unit 30 includes a bank separation portion 31 which performs so-called bank separation, the operation of which is described later.

The main separation unit 40 is installed at the downstream side of the feeding direction of the preliminary separation unit 30. The main separation unit 40 includes a so-called retard roller 41 which is rotated by a predetermined load. The retard roller 41 is installed to make a pair with an intermediate driving roller 50 which is driven by the power of the first motor 91. The retard roller 41 is installed to be moved by a swivel mechanism 43 to bring the retard roller close to or away from the intermediate driving roller 50. More specifically, the swivel mechanism 43 is configured to hold the retard roller 41 by a retard holder (not illustrated) and swivel around a swivel shaft (not illustrated) as a fulcrum point.

One end portion of the biasing spring (not illustrated) is engaged with a base portion 2, and the other end portion is engaged with a free end side of the retard holder (not illustrated). Accordingly, the retard roller 41 can be biased in a direction to approach the intermediate driving roller 50. In addition, the swivel mechanism 43 is a unit for moving the retard roller 41 against the biasing force of the biasing spring (not illustrated) so as to be spaced apart from the intermediate driving roller 50, and has a cam portion 45 which is driven by the power of a second motor 92. The cam portion 45 is engaged with a convex portion (not illustrated) of the retard holder (not illustrated) to constitute a groove cam mechanism, and is installed to move the retard roller 41 away from the intermediate driving roller 50 through the retard holder (not illustrated).

In addition, a first assist roller 48 is installed and rotatably driven between the bank separation portion 31 and the retard roller 41. The first assist roller 48 is installed to smoothly guide the leading end of the paper P passing through the bank separation portion 31 to a nip point N between the retard roller 41 and the intermediate driving roller 50.

At the downstream side of the feeding direction from the nip point N between the retard roller 41 and the intermediate driving roller 50, paper leading-end restricting ribs 60 and 60 described later are installed.

At the further downstream side of the feeding direction, a second assist roller 51 is installed which is rotatably held at the base portion 2 and circumscribes the intermediate driving roller 50. The second assist roller 51 is configured to form the pair of the feed rollers 96 with the intermediate driving roller 50. In addition, a third assist roller 52 is rotatably installed at the further downstream side of the feeding direction.

Herein, a feed path of the paper P is formed in the shape of "U" in side view from the pick-up unit 20 to the transport unit 70. More specifically, the U-shaped feed path is formed by a U-shaped outer-side paper guide portion 11 guiding the paper P from a U-shaped outer side, an inner-side paper guide portion 12 guiding the paper from an inner side, the bank separation portion 31 and a rolling-up prevention portion 13 which will be described later.

Accordingly, it is possible to reduce the frictional resistance, which is generated between the paper P and the U-shaped outer-side paper guide portion 11 of the base portion 2, by the first assist roller 48 to the third assist roller 52. As a result, the paper P can be smoothly fed to the transport unit 70 which is in the further downstream side of the feeding direction.

In this instance, the intermediate driving roller 50 and the second assist roller 51, which constitute the pair of the feed rollers 96, are installed in plural in the widthwise direction X. The reason is that a sufficient feeding force is applied to the paper in the passage which is formed in the shape of "U" in side view, thereby feeding the paper P reliably to the downstream side of the feeding direction.

The transport unit 70 includes a pair of transport rollers 71 to transport the paper P. The pair of transport rollers 71 has a transport driving roller 72 which is driven by the power of a fourth motor 94, and a transport driven roller 73 which is rotatably driven. Among them, the transport driven roller 73 is rotatably held by a driven roller holder 74.

The driven roller holder 74 brings the transport driven roller 73 into pressure contact with the transport driving roller 72 by the biasing unit (not illustrated).

In addition, a first paper detector 75 is installed at a position adjacent to the upstream side of the pair of transport rollers 71 in the feeding direction Y to detect the presence of absence of the paper P. More specifically, the first paper detector 75 has a swivel-type paper detecting lever 77 and a sensor portion 76. One end portion of the paper detecting lever 77 comes into contact with the paper P and thus the first paper detector 75 swivels. The other end portion of the paper detecting lever 77 is removed from a gap between a light emitting portion and a light receiving portion, which are not illustrated, of the sensor portion 76, so that the first paper detector 75 is in a turned-on state.

The transport unit 70 is installed to transport the paper P to the recording unit 80 installed at the downstream side of the feeding direction.

The recording unit 80 includes a recording head 82 ejecting ink onto the paper P to execute the record, and a medium support portion 81 supporting the paper P opposite to the recording head 82 under the recording head.

After that, the recorded paper P is discharged to a discharge tray (not illustrated) at the front side of the printer 1 by a discharge roller of a discharge unit which is not illustrated.

Next, the paper feeding operation will be described in detail.

As shown in FIG. 1, when the paper P1, which is located at the uppermost position with respect to the pick-up roller 21 mounted at the cassette portion 14, is picked up, the controller 90 swivels the arm section 22 to bring the pick-up roller 21 to come into contact with the uppermost paper P1. The controller drives a third motor 93 to rotate the pick-up roller 21 in a clockwise direction in the figure.

In this instance, the pick-up roller 21 is biased in a direction to approach the paper P by the biasing unit (not illustrated). Accordingly, the frictional force is generated between the pick-up roller 21 and the uppermost paper P1 to produce a feeding force which is a force to feed the paper to the downstream side of the feeding direction. Then, the uppermost paper P1 starts to move in the downstream side of the feeding direction by the feeding force. That is, the uppermost paper is picked up and then fed to the downstream side.

In this instance, the frictional coefficient between the pick-up roller 21 and the uppermost paper P1 is set as $\mu 1$, while the frictional coefficient between the paper P and the paper P is set as $\mu 2$. Moreover, the frictional coefficient between the pad unit 15 made of cork material, which is one example of the friction member provided at a position opposite to the pick-up roller 21 of the base body side, and the paper P is set as $\mu 3$. In this instance, it is configured so that the relationship of frictional coefficient $\mu 1$>the frictional coefficient $\mu 3$>the frictional coefficient $\mu 2$ is satisfied. Therefore, it is possible to reduce a so-called double paper feed in which several sheets of paper P are overlapped and doubly fed.

In addition, when picking up, the retard roller 41 has approached to the intermediate driving roller 50.

As described in detail later, displacement members 5 and 5 are installed adjacent to both sides of the pad unit 15 in a widthwise direction X (refer to FIGS. 11 and 12). The pad unit 15 is installed on the placing plane 18 on which the paper P is stacked. A top portion 15*a* of the pad unit 15, which is positioned at the upward side in the stacked direction of the paper P, is installed to slightly protrude upward in the stacked direction with respect to the placing plane 18. When the paper P is fed to the downstream side of the feeding direction by the pick-up roller 21, the pad unit 15 should reliably come into contact with the rear surface of the lowermost paper P placed. Accordingly, it is possible to reduce double paper feeds.

Figure 2:
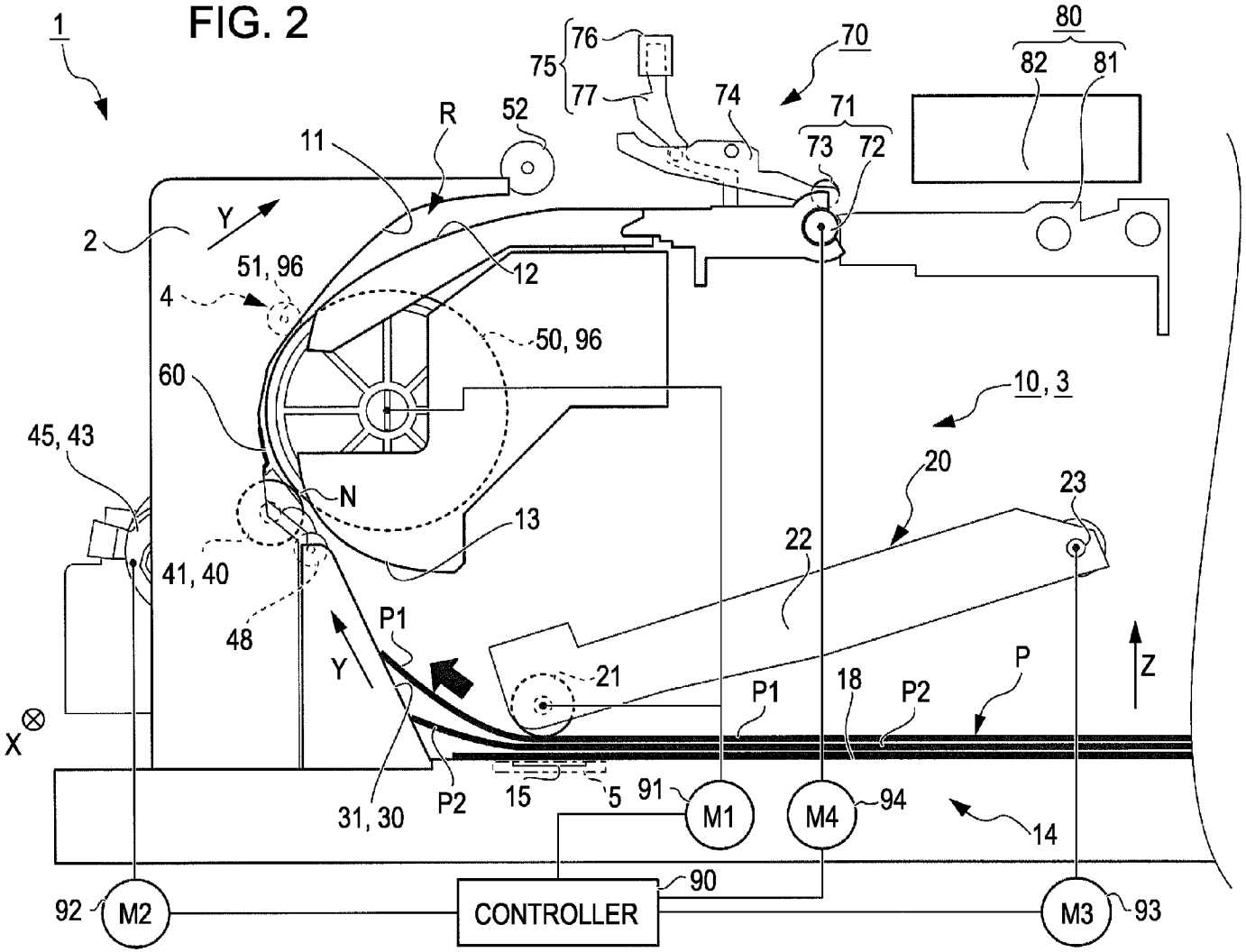
FIG. 2 is a side view illustrating an operation of bank separation in an inside of a printer according to the invention.

FIG. 2 is a side view illustrating the operation of the bank separation in the inside of the printer according to the invention.

As shown in FIG. 2, the paper P picked up by the pick-up roller 21 is fed to the downstream side of the feeding direction. The fed paper P enters the bank separation portion 31 serving as the preliminary separation portion 30.

By the frictional coefficient $\mu 2$ between the uppermost paper P1 and the second uppermost paper P2 by the pick-up roller 21, and the biasing force to bias the pick-up roller 21, a feeding force may be produced at the second uppermost paper P2.

In this instance, the second uppermost paper P2 is fed to the downstream side of the feeding direction by the pick-up roller 21, as well as the uppermost paper P1.

Accordingly, in order to separate the doubly-fed second uppermost paper P2 from the uppermost paper P1, the paper P enters the bank separation portion 31 which is installed at an angle to displace the posture of the leading end of the paper P. Abutment of the leading end of the paper P against the bank separation portion 31 causes to stop the second uppermost paper P2. In addition, a gap may be provided between the uppermost paper P1 and the second uppermost paper P2. Consequently, it is possible to separate the doubly-fed second uppermost paper P2 from the uppermost paper P1.

Figure 3:
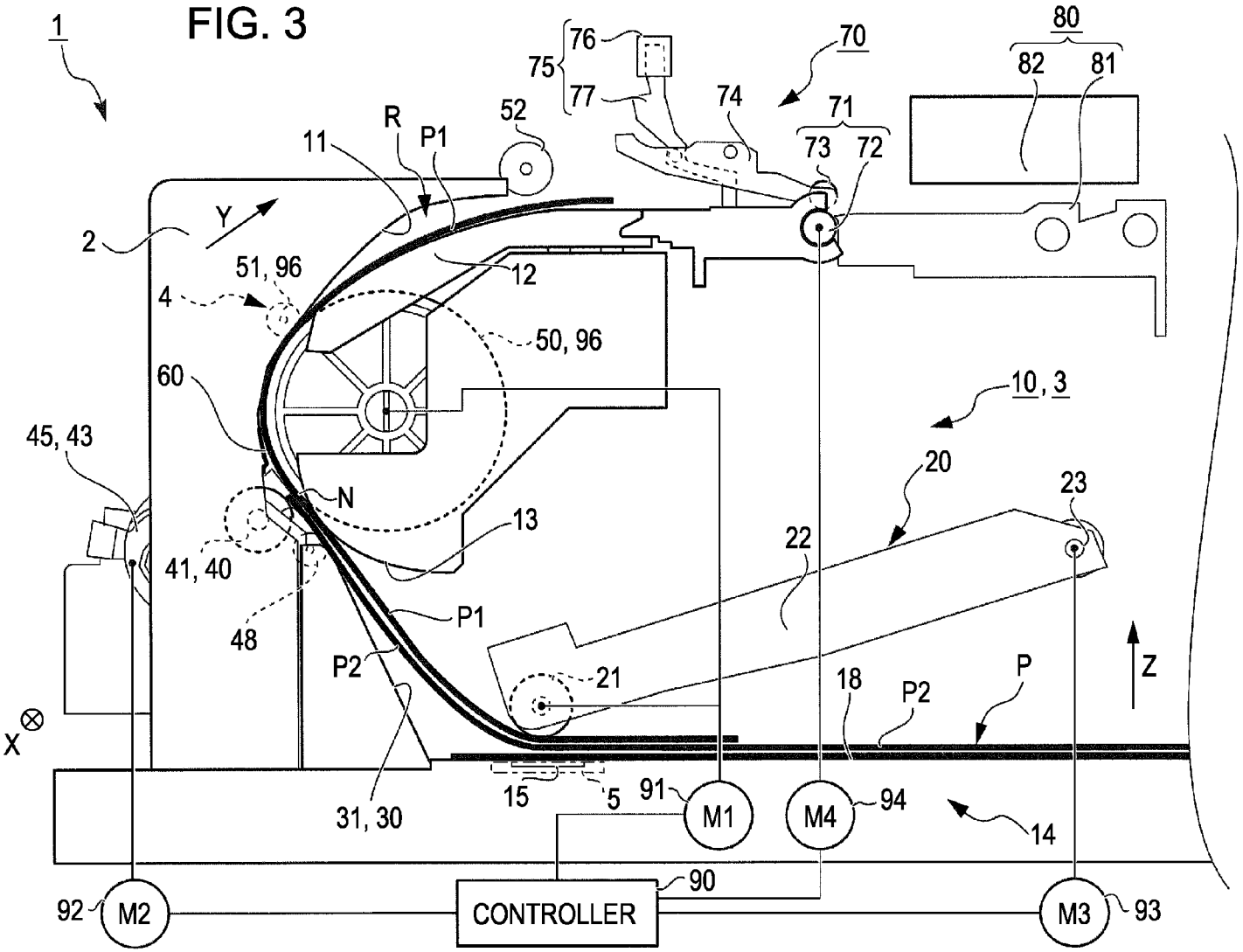
FIG. 3 is a side view illustrating an operation of retard separation in an inside of a printer according to the invention.

FIG. 3 is a side view illustrating the operation of the retard separation in the inside of the printer according to the invention.

As shown in FIG. 3, the paper P separated by the bank separation portion 31 is further fed to the downstream side of the feeding direction by the pick-up roller 21. The paper P is fed to the nip point N at which the retard roller 41 serving as the main separation portion 40 circumscribes the intermediate driving roller 50.

In this embodiment, since the preliminary separation member 30 is a preliminary separation unit all the way, several sheets of paper P may be doubly fed in the main separation portion 40. Hereinafter, it will be described on the premise in which several sheets of paper P are doubly fed.

If the doubly-fed paper P is fed to the nip point N, only the uppermost paper P1 directly comes into contact with the intermediate driving roller 50. In addition, the leading end of the second uppermost paper P2 comes into contact with the retard roller 41 which is accompanied with the predetermined load upon rotation.

Herein, the frictional coefficient between the intermediate driving roller 50 and the uppermost paper P1, the frictional coefficient between the paper P1 and the paper P2, and the frictional coefficient between the retard roller 41 and the paper P2 are respectively set as $\mu 4$, $\mu 2$ and $\mu 5$. In this instance, it is configured to satisfy the relationship of the frictional coefficient $\mu 4$>the frictional coefficient $\mu 2$, and the frictional coefficient $\mu 5$>the frictional coefficient $\mu 2$.

Accordingly, it is possible to set the feeding force acting on the uppermost paper P1 higher than the feeding force which acts on the second uppermost paper P2.

The retard roller 41 is configured so that the load of the retard roller becomes higher than the feeding force which acts on the second uppermost paper P2.

Accordingly, it is possible to feed only the uppermost paper P1 to the downstream side of the feeding direction by rotating the intermediate driving roller 50 in the clockwise direction in the figure.

More specifically, the leading end of the second uppermost paper P2 is held at the nip point N by the load of the retard roller 41 to cause slippage between the uppermost paper P1 and the second uppermost paper P2. Therefore, it is possible to separate the uppermost paper P1 from the second uppermost paper P2 and then feed it to downstream side of the feeding direction. The leading end of the uppermost paper P1 passes through the second assist roller 51, and is guided by the U-shaped outer-side paper guide portion 11 and the U-shaped inner-side paper guide 12 to reach the third assist roller 52.

Figure 4:
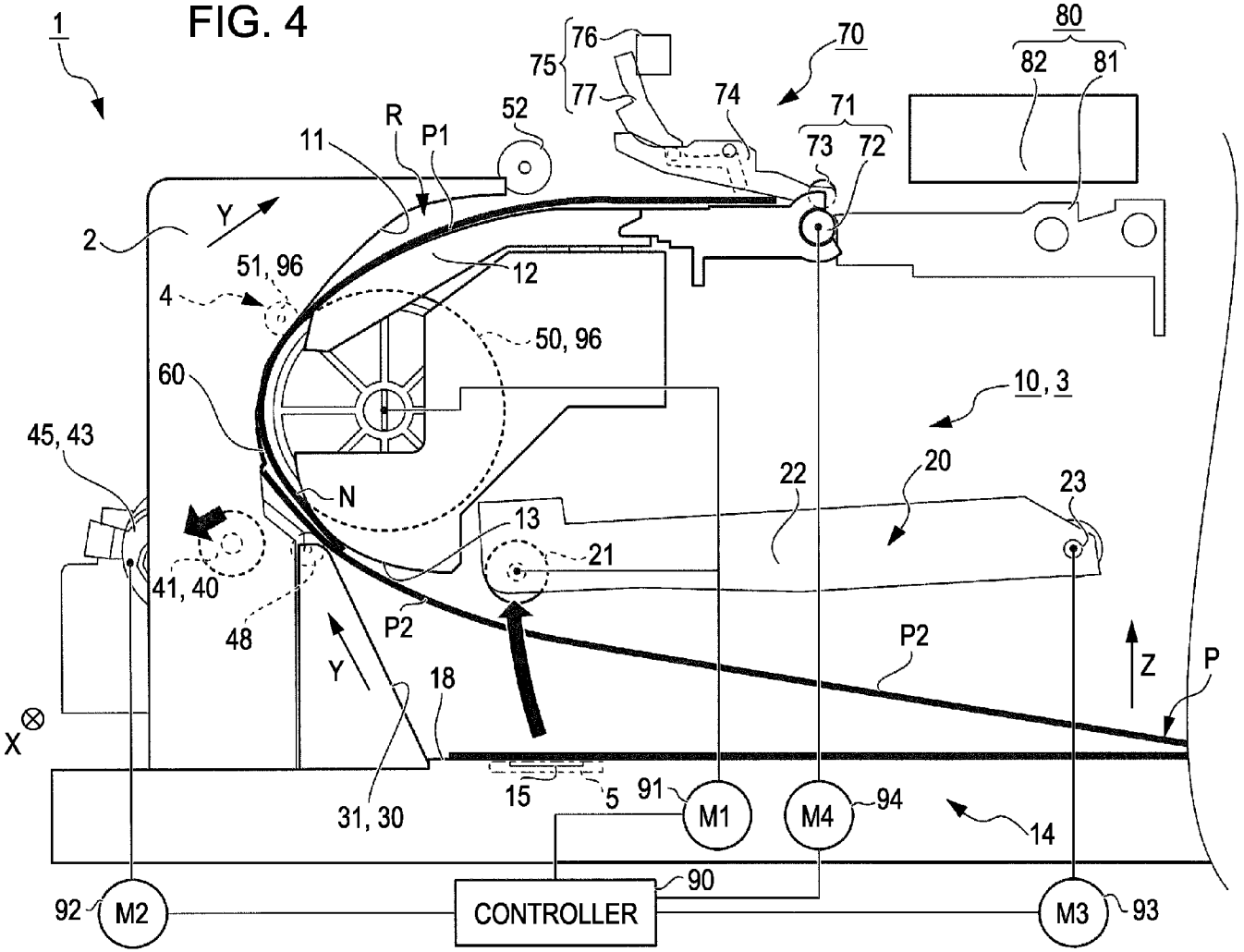
FIG. 4 is a side view illustrating an operation after retard separation in an inside of a printer according to the invention.

FIG. 4 is a side view illustrating the operation after the retard separation in the inside of the printer according to the invention.

As shown in FIG. 4, if the uppermost paper P1 is further fed to the downstream side of the feeding direction with respect to the intermediate driving roller 50, the leading end of the uppermost paper P1 is detected by the first paper detector 75. More specifically, the leading end of the uppermost paper P1 comes into contact with one end portion of the paper detecting lever 77 to swivel the paper detecting lever 77. In this instance, since the other end portion of the paper detecting lever 77 is removed from a gap between the light emitting portion and the light receiving portion of the sensor 76, the first paper detector 75 is turned on.

The controller 90 moves the retard roller 41 away from the intermediate driving roller 50 by using the turned-on state of the first paper detector as a trigger. More specifically, the cam portion 45 is rotated by the second motor 92, so that the retard holder (not illustrated) is swiveled in a retreat direction with respect to the intermediate driving roller 50 against the biasing force of the biasing spring (not illustrated).

The controller 90 drives the third motor 93 to swivel the arm section 22 around the arm shaft 23 as a fulcrum point in the direction in which the pick-up roller 21 is retreated from the paper P placed on the cassette portion 14.

In this instance, the timing for starting the spacing movement of the retard roller 41 may be set as a time when the intermediate driving roller 50 and the pick-up roller 21 reach the predetermined rotation amount.

If the retard roller 41 moves away, the uppermost paper P1 is fed by the intermediate driving roller 50 and the second assist roller 51.

In addition, if the pick-up roller 21 moves away, the feeding force from the intermediate driving roller 50 and the pick-up roller 21 does not directly act on the second uppermost paper P2. Accordingly, the second uppermost paper P2, of which the leading end thereof is held by the retard roller 41, tries to return to the cassette portion 14 by its own weight.

The trailing end of the preceding paper P1 which is the uppermost paper fed by the intermediate driving roller 50 comes into contact with the leading end of the subsequent paper P2 which is the second uppermost paper P2, of which the leading end thereof is held by the retard roller 41. Accordingly, the feeding force indirectly acts on the subsequent paper P2.

Therefore, the paper leading-end restricting ribs 60 and 60 of a convex shape are installed at the downstream side of the feeding direction from the nip point N between the intermediate driving roller 50 and the retard roller 41 in the U-shaped outer-side paper guide portion 11. In addition, the paper leading-end restricting ribs 60 and 60 are installed adjacent to both sides of the retard roller 41 in the widthwise direction X of the paper P.

Since the feed path is bent in the U-shape, when the retard roller 41 moves away, the leading end of the subsequent paper P2 which is the second uppermost paper is displaced toward the U-shaped outer-side paper guide portion.

Accordingly, the paper leading-end restricting ribs 60 and 60 come into contact with the leading end of the subsequent second uppermost paper P2 to restrict the displacement toward the downstream side of the feeding direction, after the retard roller 41 moves away.

That is, it is possible to reliably prevent the subsequent paper P2 from feeding to the downstream side of the feeding direction. As a result, it is possible to prevent the so-called accompanying paper feed, in which the subsequent paper P2 is fed together with the preceding paper P1. The accompanying paper feed likely happens in a case of feeding, in particular, the large-sized paper P of which a contact area between the subsequent paper P2 and the preceding paper P1 is increased. More specifically, it likely happens in the A3 size or larger. In other words, if it is equal to or smaller than the A4 size, the contact area is small, and thus the possibility of the accompanying paper feed is low.

In this instance, it is possible to reduce the flexure amount of the subsequent paper P2 by moving away the pick-up roller 21. That is, the posture of the subsequent paper P2 can be maintained as straight as possible. Therefore, the leading end of the subsequent paper P2 can be actively abutted against the paper leading-end restricting ribs 60 and 60.

The trailing end of the preceding paper P1 acts to push the leading end of the subsequent paper P2 towards the outside of the U-shaped passage, that is, the U-shaped outer-side paper guide portion. Therefore, the leading end of the subsequent paper P2 can actively come into contact with the paper leading-end restricting ribs 60 and 60.

As a result, the accompanying paper feed can be reliably prevented. That is, the accompanying paper feed can be prevented without installing a so-called return lever which is provided in the related art.

In addition, the retard roller 41 can be moved away at the timing faster than that of the related art. As a result, it is possible to decrease the so-called back tension at the fast timing by the load of the retard roller 41. For example, when the leading end of the uppermost paper P1 reaches the second assist roller 51, the retard roller 41 can start to move away.

Figure 5:
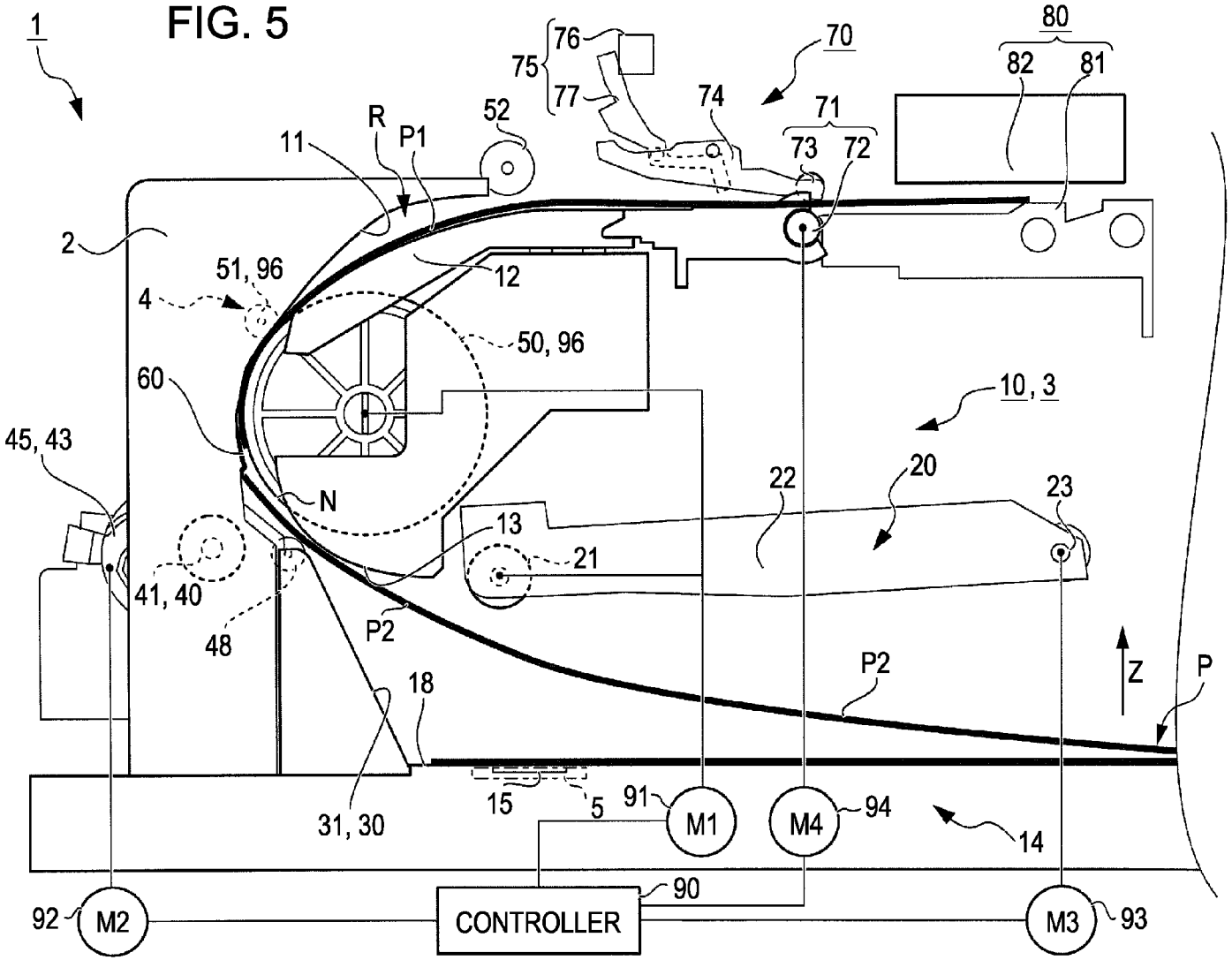
FIG. 5 is a side view illustrating an operation after retard separation in an inside of a printer according to the invention.

FIG. 5 is a side view illustrating the operation after the retard separation in the inside of the printer according to the invention.

As shown in FIG. 5, when the uppermost paper, that is, the preceding paper P1, is further fed to the downstream side of the feeding direction with respect to the intermediate driving roller 50 from the state shown in FIG. 4, the trailing end of the preceding paper P1 passes between the intermediate driving roller 50 and the retard roller 41.

The rolling-up prevention portion 13 is installed in the inside of the U-shaped passage. More specifically, the rolling-up prevention portion 13 is installed to cover the intermediate driving roller 50 at the upstream side of the feeding direction from the nip point N between the intermediate driving roller 50 and the retard roller 41 in the feeding direction Y. Accordingly, the rolling-up prevention portion 13 can prevent the subsequent paper P2 from coming into contact with the intermediate driving roller 50.

As a result, the intermediate driving roller 50 cannot directly apply the feeding force onto the subsequent paper P2.

The leading end of the preceding paper P1 is nipped between the pair of the transport rollers 71. After that, the skew removal is executed, and thus the preceding paper P1 is transported to the downstream side of the feeding direction by the pair of transport rollers 71, so that the preceding paper P1 is recorded by the recording unit 80. The preceding paper P1 is discharged by the discharge unit (not illustrated) to the discharge tray (not illustrated) in the front of the printer 1.

Next, the skew removal operation will be described.

Figure 6:
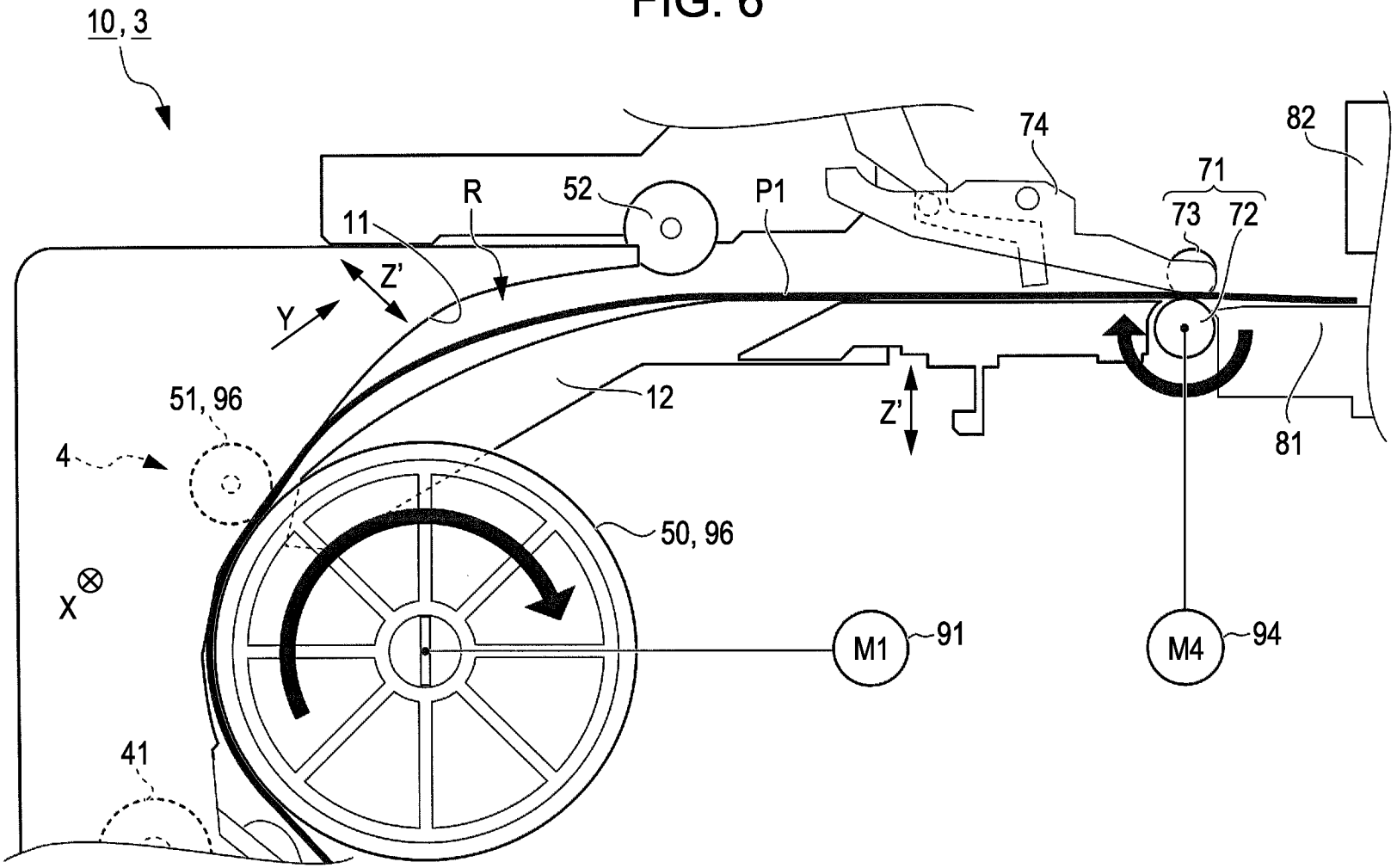
FIG. 6 is a side view illustrating an initial nip state at the time of skew removal according to the invention.

FIG. 6 is a side view illustrating an initial nip state at the time of skew removal according to the invention.

As shown in FIG. 6, the controller 90 drives the first motor 91 in the forward rotation to rotate the intermediate driving roller 50 in the clockwise direction in the figure. In addition, the controller drives the fourth motor 94 in the forward rotation to rotate the transport driving roller 72 in the clockwise direction in the figure.

Therefore, the leading end of the preceding paper P1 is nipped between the pair of transport rollers 71 as described above. The preceding paper P1 is fed until the leading end of the paper P1 is positioned at the downstream side from the pair of transport rollers 71 by the predetermined amount.

In this instance, the posture of the leading end of the paper P1 may be tilted to a nip line of the pair of transport rollers 71. It is called as a skew. At that time, the nip line is an X-axis direction.

Therefore, the following operation is executed in order to remove the slope of the paper P1 with respect to the nip line, that is, a so-called skew removal.

Figure 7:
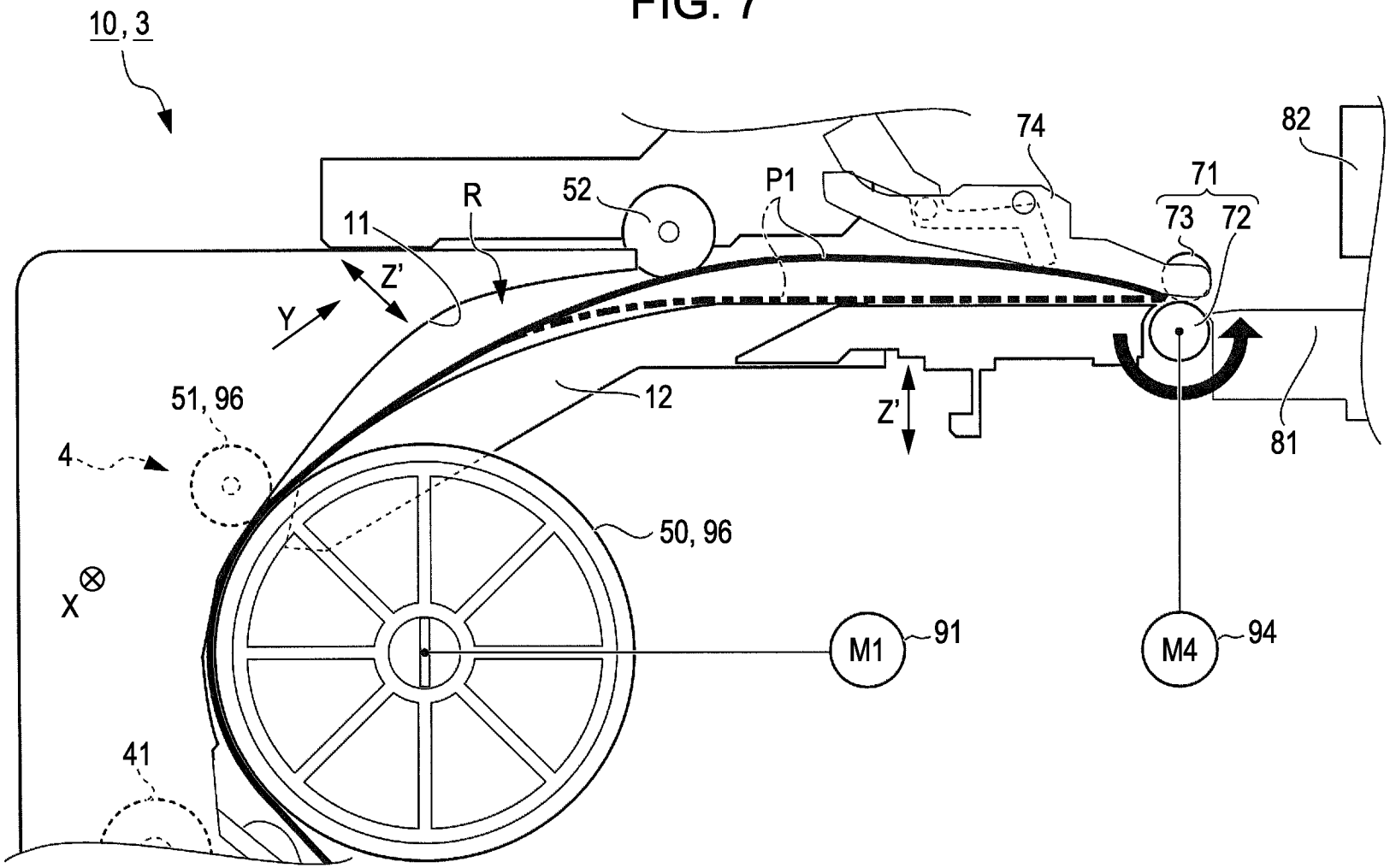
FIG. 7 is a side view illustrating a discharge state at the time of skew removal according to the invention.

FIG. 7 is a side view illustrating the discharge state at the time of the skew removal according to the invention.

As shown in FIG. 7, in the state shown in FIG. 6, the controller 90 stops the first motor 91 thereby to stop the intermediate driving roller 50. In addition, the controller 90 drives the fourth motor 94 in a reverse rotation to rotate the transport driving roller 72 in a counterclockwise direction in the figure. Therefore, the leading end of the preceding paper P1 is reversely fed to the upstream side of the pair of transport rollers 71 by the pair of transport rollers 71. It is a so-called discharge operation.

In this instance, the intermediate driving roller 50 is paused. Therefore, the preceding paper P1 can be bent between the pair of transport rollers 96 consisting of the intermediate driving roller 50 and the second assist roller 51, and the pair of transport rollers 71 in the feeding direction Y.

The leading end of the preceding paper P1 can follow the nip line of the pair of transport rollers 71.

In the case in which the paper P1 is tilted to the nip line in the state shown in FIG. 6, one end portion of the paper P1 in the widthwise direction X which is indicated by a solid line in FIG. 7 is largely bent, and the other end portion of the paper P1 in the widthwise direction X which is indicated by a chain line is slightly bent. In addition, the difference in size between the one end portion and the other end portion of the paper P1 in the widthwise direction X is proportional to the size of the slope of the leading end of the paper in the state shown in FIG. 6.

In the case in which the paper P1 is not tilted to the nip line in the state shown in FIG. 6, the one end portion and the other end portion of the paper in the widthwise direction X in FIG. 7 have the posture indicated by the solid line.

Figure 8:
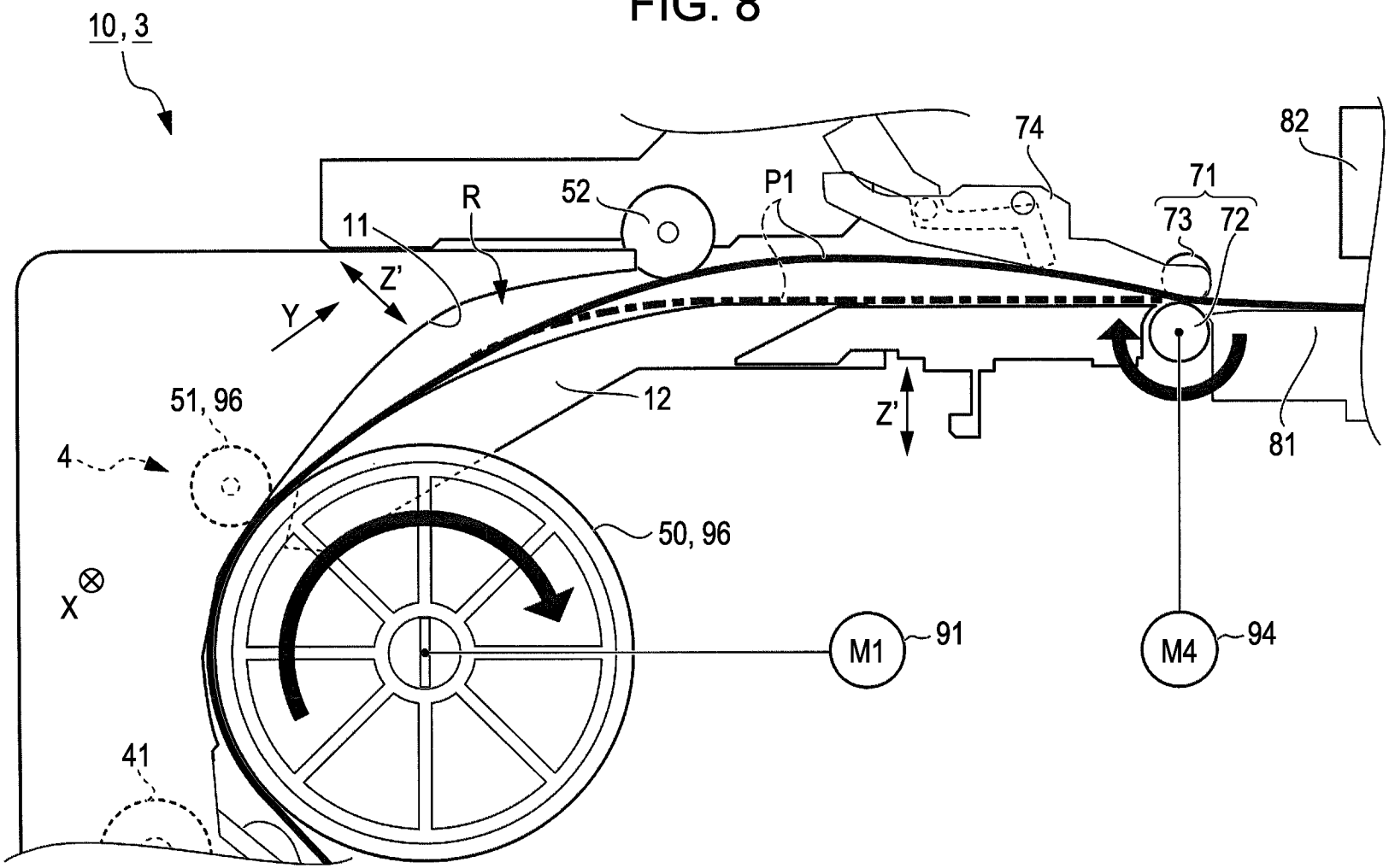
FIG. 8 is a side view illustrating a cue state at the time of skew removal according to the invention.

FIG. 8 is a side view illustrating a cue state at the time of the skew removal according to the invention.

As shown in FIG. 8, the controller 90 drives the first motor 91 in the forward rotation in the state of FIG. 7 to rotate the intermediate driving roller 50 in the clockwise direction in the figure. In addition, the controller 90 drives the fourth motor 94 in the forward rotation to rotate the transport driving roller 72 in the clockwise direction in the figure. Therefore, the leading end of the paper P1 which is not tilted to the nip line can be nipped between the pair of transport rollers 71. The leading end of the preceding paper P1 is fed to the recording start position, and then the first motor 91 and the fourth motor 94 are stopped. It is the so-called cue operation.

The term "recording start position" used herein means a position opposite to the nozzle array (not illustrated) of the recording head 82.

In this instance, between the pair of feed rollers 96 and the pair of transport rollers 71 in the feeding direction Y, the difference between the one end portion and the other end portion of the paper P in the widthwise direction X is not eliminated.

As described in the related art, by the difference between the flexure amount of the one end portion and the flexure amount of the other end portion, a difference may occur between the transport amounts of the one end portion and the other end portion in the pair of transport rollers 71.

Accordingly, the following operation is executed in order to eliminate the difference between the flexure amount of the one end portion and the flexure amount of the other end portion.

Figure 9:
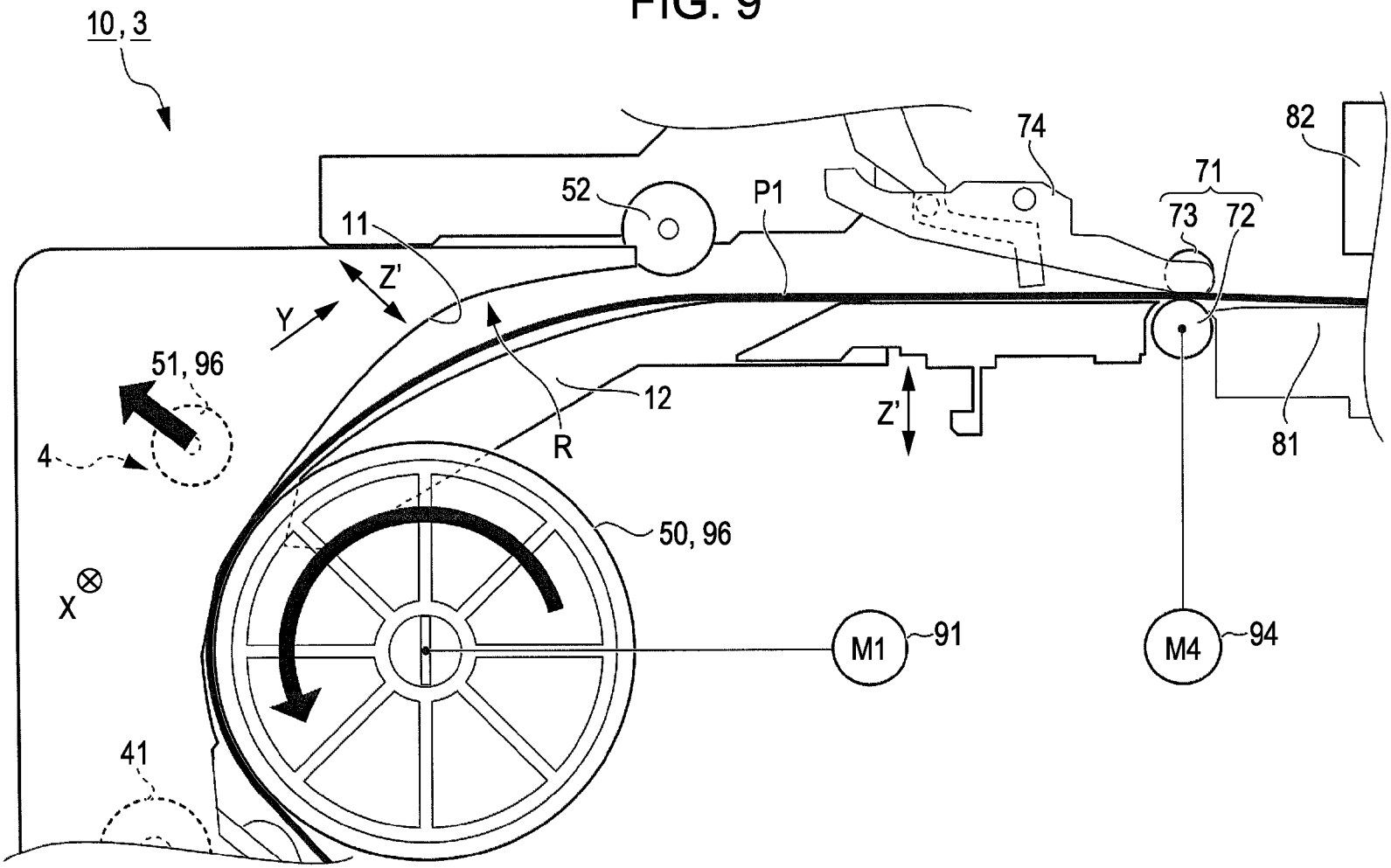
FIG. 9 is a side view illustrating an operation of reverse rotation after skew removal according to the invention.

FIG. 9 is a side view illustrating the operation of the reverse rotation after the skew removal according to the invention.

As shown in FIG. 9, the controller 90 in the state of FIG. 8 first moves the second assist roller 51 in a direction away from the intermediate driving roller 50 by using a switching mechanism 4.

The switching mechanism 4 is configured to switch between a first state in which the second assist roller 51 approaches the intermediate driving roller 50, and a second state in which the second assist roller 51 is spaced apart from the intermediate driving roller 50. For example, since the switching mechanism includes a cam, as in the above-mentioned swivel mechanism 43, the switching mechanism can be switched between the first state and the second state.

On the contrary to this, the switching mechanism may be configured to move the intermediate driving roller 50 in a direction away from the second assist roller 51. In such a case, it can obtain the same advantageous effect as that described later. In this embodiment, the reason why it is configured to move the second assist roller 51 is that the intermediate driving roller 50 drives. That is, it is easy to move the second assist roller 51 which is a driven rotation side, rather than moving the intermediate driving roller 50 which is a driving side.

Next, the first motor 91 is driven in a reverse rotation to rotate the intermediate driving roller 50 in the counterclockwise direction in the figure. During this time, the fourth motor 94 is paused.

In this instance, the second assist roller 51 is spaced apart from the intermediate driving roller 50. Accordingly, the intermediate driving roller 50 can apply an appropriate reverse feeding force on the paper P1 in the upstream side of the feeding direction, while being sliding between the paper P1 and the outer circumference of the intermediate driving roller 50.

The term "appropriate reverse feeding force" used herein means a reverse feeding force of the degree to which the extra flexure can be eliminated, for example, by slightly pressing the paper P1 in the inside of the U-shaped feed path between the pair of feed rollers 96 and the pair of transport rollers 71 in the feeding direction Y. In the state in which the extra flexure is eliminated so as not to further displace the paper P1 to the inside, slippage is typically generated between the paper P1 and the outer circumference of the intermediate driving roller 50. Therefore, the paper P1 may not be damaged.

As a result, it is possible to reduce the flexure amount of the paper P1 occurring between the pair of feed rollers 96 and the pair of transport rollers 71 in the feeding direction Y.

In addition, it is possible to reduce the difference between the flexure amount of the one end portion of the paper P1 and the flexure amount of the other end portion of the paper P1. After that, consequently, no difference occurs between the flexure amount of the one end portion of the paper P1 and the flexure amount of the other end portion of the paper P1 in the pair of transport rollers 71 at the time of recording operation.

Moreover, when the intermediate driving roller 50 is driven in the reverse rotation, the pick-up roller 21 is moved away from the paper P, as described above (refer to FIG. 6). Accordingly, it is not possible to disturb the reduction of the difference between the flexure amount of the one end portion of the paper P1 and the flexure amount of the other end portion of the paper P1.

After that, the reverse rotation of the intermediate driving roller 50 is stopped. The first motor 91 is driven in the forward rotation to rotate the intermediate driving roller 50 in the clockwise direction in the figure. In addition, the fourth motor 94 is driven in the forward rotation to rotate the transport driving roller 72 in the clockwise direction in the figure. As describe above, the preceding paper P1 is transported to the downstream side of the feeding direction by the pair of transport rollers 71, and then is recorded by the recording unit 80.

After that, by the discharge unit (not illustrated), the paper is discharged to the discharge tray (not illustrated) in the front of the printer 1.

In this instance, the timing for rotating the intermediate driving roller 50 in the clockwise direction may be the timing for starting the pick-up of the subsequent paper P described later. That is, during the transport, the feeding force may be generated by the pair of transport rollers 71 and the pair of the feed rollers 96, and the feeding force may be generated only by the pair of transport rollers 71.

In addition, although the skew removal operation of "a nip and release method" has described in this embodiment, a so-called "abutment method" may be employed.

The term "abutment method" used herein means that the paper P1 is fed to the downstream side of the feeding direction by the pair of transport rollers 96 as described above, and then the leading end of the paper P1 is pressed against the nip line of the pair of transport rollers 71 which is paused or is driven in the reverse rotation, so that the posture of the leading end follows the nip line. That is, it means that the posture of the leading end follows the nip line by abutting the leading end of the paper P1 against the pair of transport rollers 71. In this instance, the paper P1 is bent between the pair of transport rollers 96 and the pair of transport rollers 71, so that the posture of the leading end follows the nip line.

Figure 10:
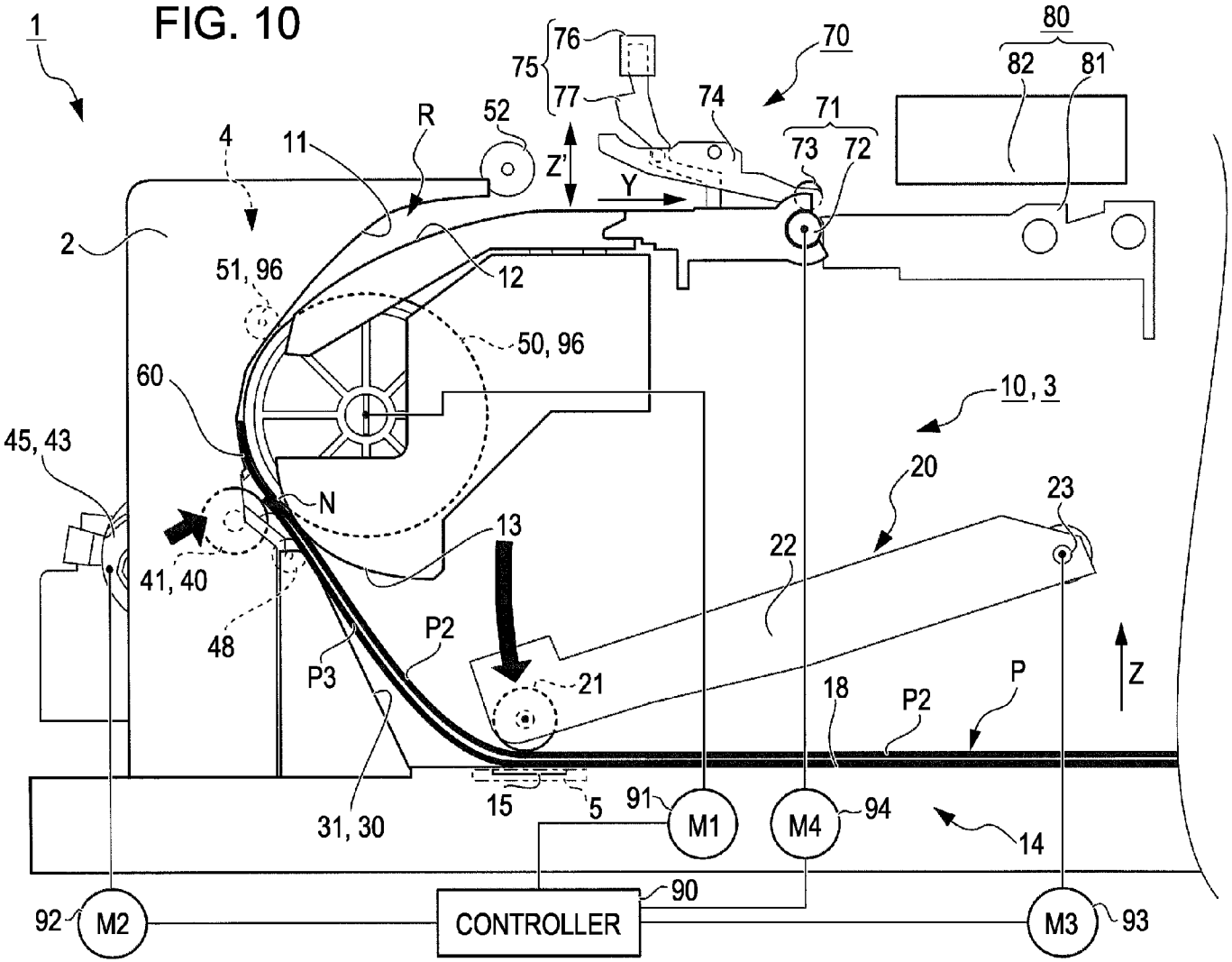
FIG. 10 is a side view illustrating a pick-up shape of subsequent paper according to the invention.

FIG. 10 is a side view illustrating the state of picking up the subsequent paper according to the invention.

As shown in FIG. 10, after the preceding paper P1 is transported to the recording unit 80, the paper P can be continuously fed. Specifically, the controller 90 detects the trailing end of the paper P1 by a first paper detector 75, and then moves the retard roller 41 and the second assist roller 51 to the intermediate driving roller 50. More specifically, the cam portion 45 is rotated by the second motor 92, and then the retard holder (not illustrated) is swiveled by the biasing force of the biasing spring (not illustrated) in a direction to approach the intermediate driving roller 50.

Similarly, the controller operates the switching mechanism 4 to move the second assist roller 51 in a direction to approach the intermediate driving roller 50.

In addition, the controller 90 drives the third motor 93 to swivel the arm section 22 around the arm shaft 23 as a fulcrum point in a rotation to approach the pick-up roller 21 to the paper P placed on the cassette portion 14.

In this instance, the subsequent paper P2 held by the paper leading-end restricting ribs 60 and 60 is displaced toward the intermediate driving roller side by the approaching movement of the retard roller 41. And then, the paper is nipped between the intermediate driving roller 50 and the retard roller 41. Accordingly, the leading end of the subsequent paper P2 is released from the restriction state of the paper leading-end restricting ribs 60 and 60. In this state, the intermediate driving roller 50 and the pick-up roller 21 are rotated in the clockwise direction in the figure as described above.

When the subsequent paper P2 held by the paper leading-end restricting ribs 60 and 60 is one sheet, one sheet of paper P2 is fed to the downstream side of the feeding direction.

In addition, the subsequent paper P2, P3, . . . held by the paper leading-end restricting ribs 60 and 60 are plural sheets, the relationship of frictional coefficient $\mu 4$>frictional coefficient $\mu 2$ and frictional coefficient $\mu 5$>frictional coefficient $\mu 2$ is satisfied as described above.

Accordingly, it is possible to set the feeding force of the intermediate driving roller 50, which acts on the uppermost paper P2, higher than that acting on the paper P3 after the next stage. That is, the paper P3 after the next stage can be separated by the retard roller 41, and then only the uppermost paper P2 can be fed to the downstream side of the feeding direction. In this instance, the leading end of the uppermost paper P2 is displaced toward the intermediate driving roller side by the approaching movement of the retard roller 41 as described above, so that the leading end cannot be restricted by the paper leading-end restricting ribs 60 and 60.

In this embodiment, the feed path is formed to have the shape of "U" in side view, but the invention is not limited thereto. The feed path may be formed to have a straight line in side view or other configuration having an R-shape of which a portion is bent in side view. In this instance, the reason is that, after the skew removal, the second assist roller 51 drives the intermediate driving roller 50 in a spaced state in a reverse rotation, thereby eliminating the difference between the flexure amounts of the left and right sides in the widthwise direction. The configuration having the R-shape, of which at least a portion is bent in side view, is preferable. The reason is that it is possible to determine to which the side of whether the paper P is bent in a thickness direction Z" of the paper P.

Next, the displacement member 5 according to the invention will be described in detail.

Figure 11:
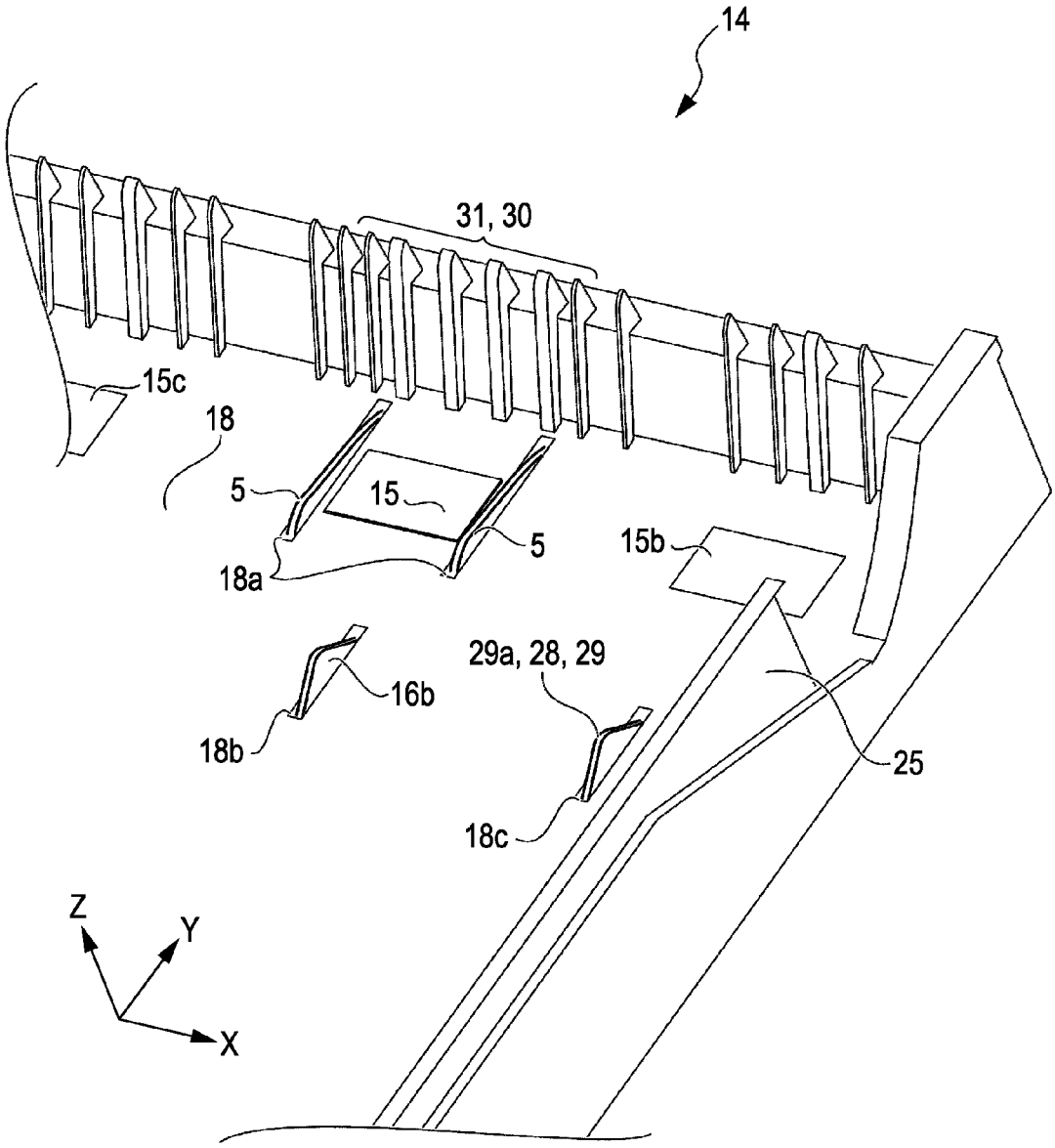
FIG. 11 is a perspective view illustrating a displacement member of a cassette unit according to the invention.

FIG. 11 is a perspective view illustrating the displacement member of the cassette unit according to the invention. FIG. 12 is a plan view illustrating the displacement member of the cassette unit according to the invention. FIG. 13 is a side cross-sectional view schematically illustrating a first state of the displacement member in a state in which the paper is not placed on the placing plane. In addition, FIG. 14 is a side cross-sectional view schematically illustrating a second state of a displacement member in a state in which the paper is placed on the placing plane.

The term "first state of the displacement member" used herein means a state in which the displacement member protrudes upwardly in a stacked direction with respect to the pad unit installed on the placing plane. The term "second state of the displacement member" used herein means a state in which the displacement member is retreated downwardly in the stacked direction with respect to the pad member.

Figure 12:
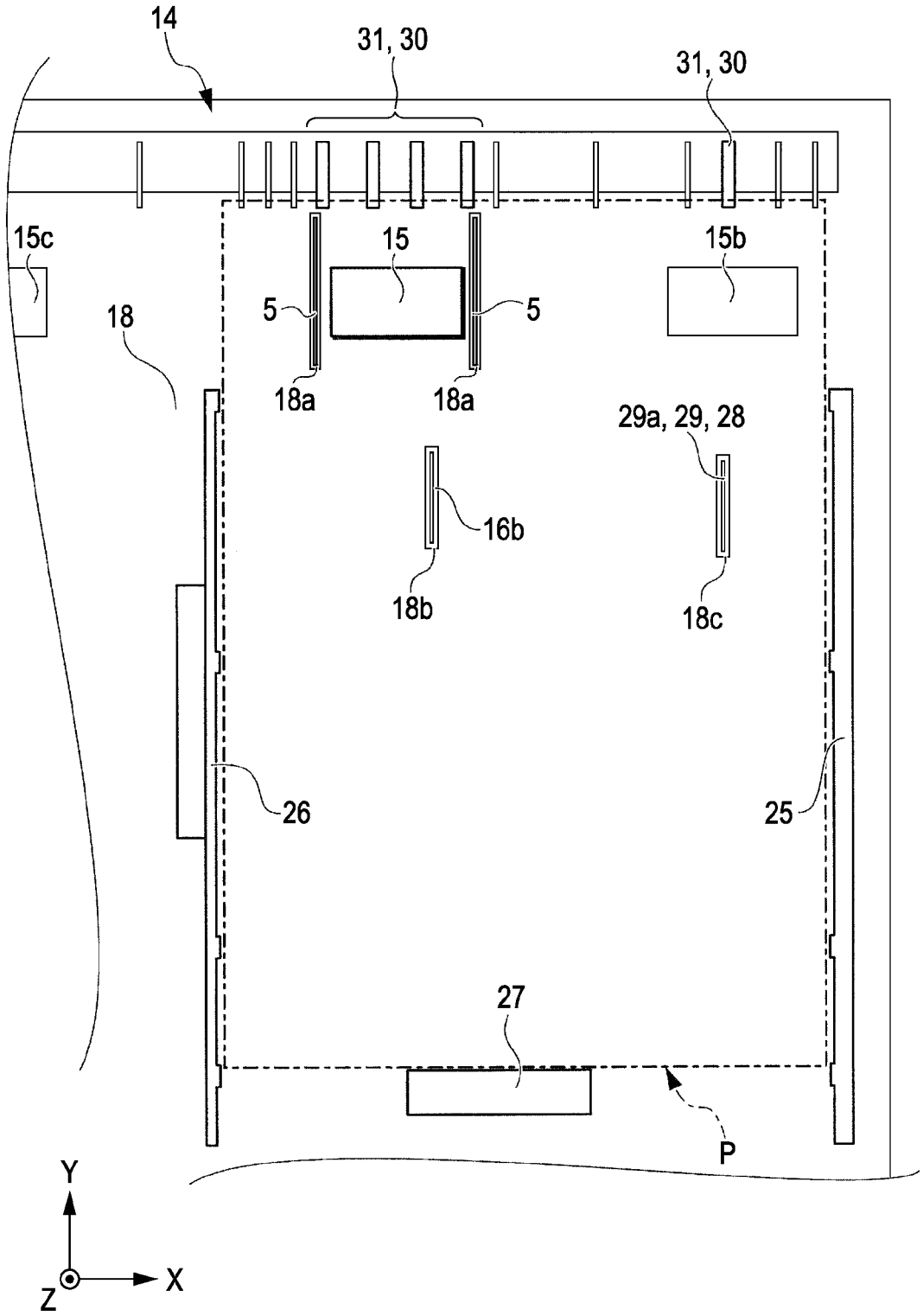
FIG. 12 is a plan view illustrating a displacement member of a cassette unit according to the invention.
Figure 13:
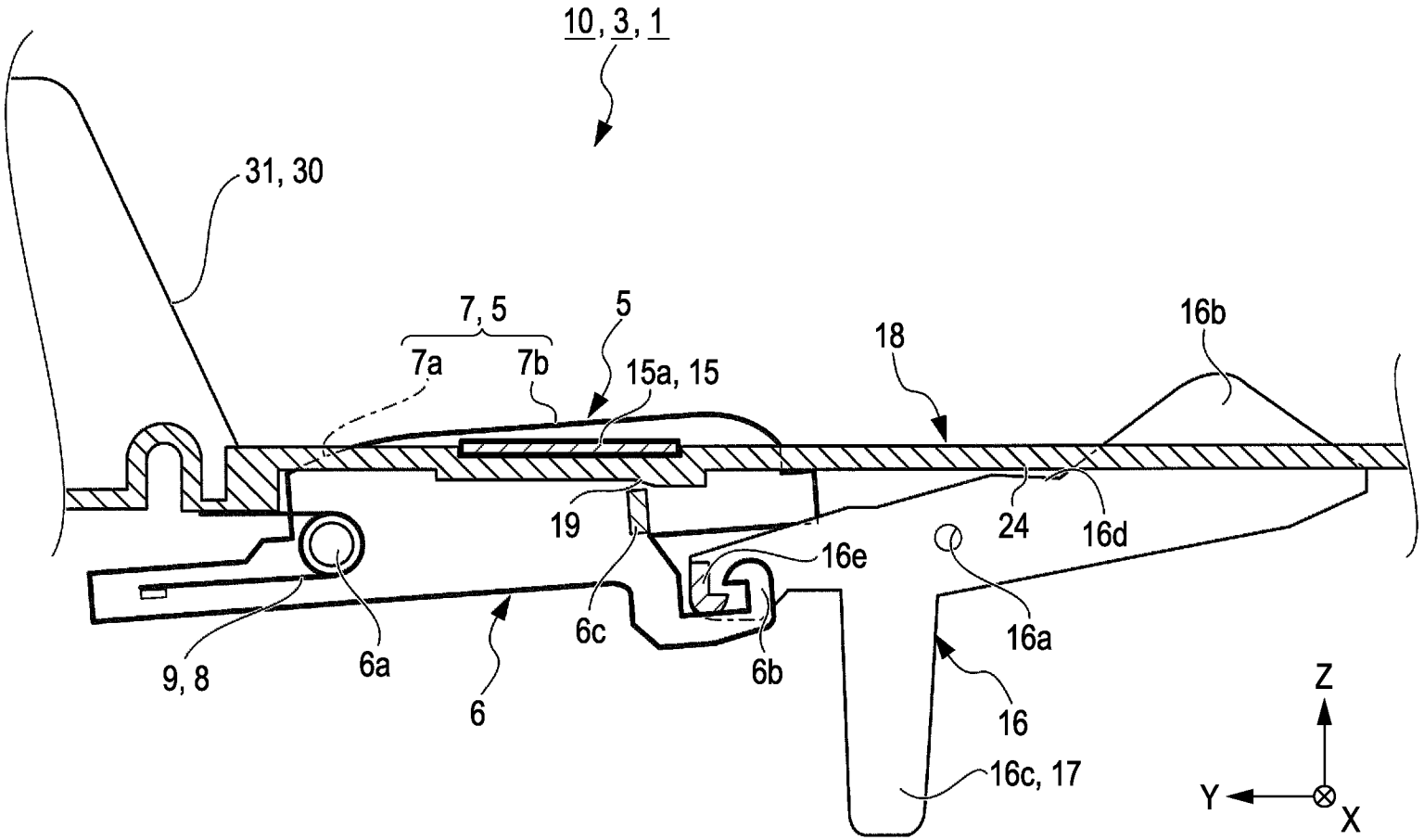
FIG. 13 is a side cross-sectional view schematically illustrating a first state of a displacement member according to the invention (when there is no paper).
Figure 14:
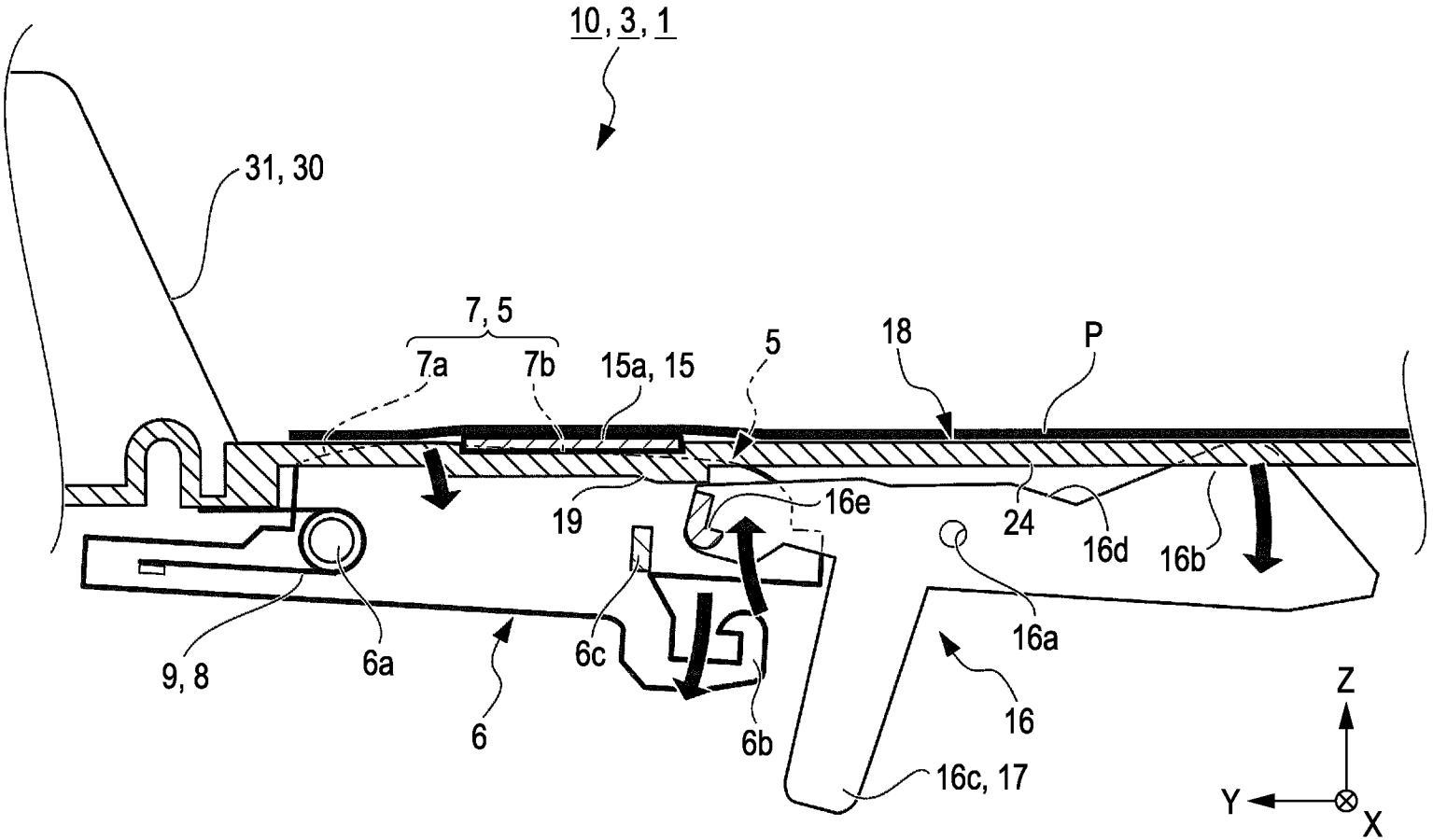
FIG. 14 is side a cross-sectional view schematically illustrating a second state of a displacement member according to the invention (when there is paper).

As shown in FIGS. 11 to 13, the cassette portion 14 is provided with a first edge guide 25 and a second edge guide 26 which come into contact with a lateral end of the paper P placed on the placing plane 18 in the widthwise direction to align the lateral ends. In addition, the cassette portion is provided with a trailing-end guide 27 to align the trailing end of the placed paper P. The first edge guide 25 is basically stationary in the widthwise direction X. The second edge guide 26 is installed to move in the widthwise direction X, so that the second edge guides can accommodate each paper size.

In addition, the trailing-end guide 27 is installed to be movable in the feeding direction Y, so that the trailing-end guide can accommodate each paper size.

The first edge guide 25 and the second edge guide 26 are configured to slightly move outward with respect to the paper P in the widthwise direction X when the placed paper P is fed to the downstream side in the feeding direction. This configuration is made to decrease the frictional resistance produced due to the contact between the lateral end of the paper P and the first and second edge guides 25 and 26, when the paper P is fed to the downstream side in the feeding direction. That is, the reason is to decrease back tension. Therefore, it is possible to stabilize the feed precision of the paper P.

In addition, the placing plane 18 is provided with first slits 18*a* and 18*a* at positions adjacent to both sides of the pad unit 15 in the widthwise direction. Moreover, the placing plane 18 is provided with a second slit 18*b* and a third slit 18*c* at the upstream side of the feeding direction more than the first slits 18*a* and 18*a*. The displacement members 5 and 5 are configured to be able to protrude upwardly in the stacked direction through the first slits 18*a* and 18*a*.

The displacement members 5 and 5 are provided with a first lever member 6 described later. Since the first slits 18*a* and 18*a* and the displacement members 5 and 5 are symmetric with respect to left and right sides, only one side will be described, while the description on the other side will be omitted.

Similarly, a projection 16*b* is configured to be able to protrude upwardly in the stacked direction through the second slit 18*b*. The displacement member 5 is formed at the first lever member 6, as described later. Similarly, the projection 16*b* is formed at the second lever member 16.

In this instance, a projection 29*a* of a third lever member 29 constituting a second paper detector 28 protrudes from the third slit 18*c*. Therefore, it is possible to detect the presence or absence of the paper P. In a case where the placed paper P is a final single sheet, it is possible to detect the timing when the trailing end of the paper P passes.

Of course, the second paper detector 28 may be constituted by the second lever member 16. In this embodiment, the reason why the second paper detector 28 is constituted by the third lever member 29 different from the second lever member 16 is that it accommodates a size of paper where the size in the widthwise direction X is shorter than the distance between the first edge guide 25 and the second slit 18*b*. That is, the paper P of all sizes which can be placed is stacked neatly on the first edge guide side, and the second paper detector 28 is installed at the position adjacent to the first edge guide 25 to accommodate the paper of all sizes.

In addition, instead of the pad unit 15, the first edge guide side is provided with a small-sized pad unit 15*b* corresponding to the paper of a size which is shorter than the length in the widthwise direction X. Moreover, instead of the pad unit 15, the second edge guide side is provided with a large-sized pad unit 15*c* corresponding to the paper of a size which is longer than the length.

In this embodiment, the distance of the feed path is constant, and the displacement member 5 according to the embodiment has consideration a fact that the pad unit 15 used in the case where the paper of a predetermined length is fed in the feeding direction comes into contact with the trailing end of the paper when the paper is reversely fed.

That is, there is no particular problem in the case where the small-sized pad unit 15*b* and the large-sized pad unit 15*c* are used. However, it is preferable to install the displacement member 5 at both sides of the small-sized pad unit 15*b*. The reason is that, in the case of using the pad unit 15, the trailing end of the paper may come into contact with the small-sized pad unit 15*b*, similar to the contact of the pad unit 15.

Next, the displacement members 5 installed at both sides of the pad unit 15 in the widthwise direction X will now be described.

As shown in FIG. 13, the first lever member 6 and the second lever member 16 are installed below the placing plane 18. Among them, the first lever member 6 has the displacement member 5, a first lever shaft 6*a*, a first engaging portion 6*b*, and a first abutting portion 6*c*. The displacement member 5 is positioned at both sides of the pad unit 15 in the widthwise direction X, and extends from the upstream side in the feeding direction Y rather than the upstream end of the pad unit 15 to the downstream side rather than the downstream end of the pad unit 15.

The displacement member 5 is installed to protrude upwardly in the stacked direction with respect to the placing plane 18 through the first slit 18*a*. In addition, the upper edge 7 of the displacement member 5 in the stacked direction is provided with a flat portion 7*b*, and a slope portion 7*a* on the downstream side of the feeding direction rather than the flat portion 7*b*. In the first state in which the displacement member 5 protrudes upwardly in the stacked direction with respect to the pad unit 15 installed at the placing plane 18, the flat portion 7*b* is positioned upwardly in the stacked direction with respect to the top portion 15*a* of the pad unit 15.

In addition, the slope portion 7*a* is inclined with respect to the placing surface 18 in such a way that the lower end is positioned downwardly in the stacked direction with respect to the placing plane 18 and is positioned upward in the stacked direction as proceeding to the flat portion 7*b* of the upstream side. The slope portion 7*a* is smoothly connected to the flat portion 7*b*.

The first lever member 6 is installed to swivel around the first lever shaft 6*a* as a fulcrum point. The first engaging portion 6*b* is installed to engage with the second engaging portion 16*e* of the second lever member 16 which will be described below. The first abutting portion 6*c* is installed to come into contact with the first restriction portion 19 which is formed below the placing plane 18.

The second lever member 16 includes a projection portion 16*b*, a second lever shaft 16*a*, a second engaging portion 16*e*, a second abutting portion 16*d*, and a weight portion 16*c* which is one example of the first biasing unit 17. Among them, the projection portion 16*b* is installed to protrude upwardly in the stacked direction with respect to the placing plane 18 through the second slit 18*b*. In this embodiment, the state in which the projection portion 16*b* protrudes upwardly with respect to the placing plane 18 is called as the third state of the projection portion 16*b*.

In addition, the second lever member 16 is installed to swivel around the second lever shaft 16*a* as a fulcrum point. Moreover, the second engaging portion 16*e* is installed to engage with the first engaging portion 6*b* of the first lever member 6, as described above. The second abutting portion 16*d* is installed to come into contact with the second restriction portion 24 formed below the placing plane 18. The weight portion 16*c* serving as the first biasing unit 17 applies a force to swivel the second lever member 16 so that the projection portion 16*b* protrudes upwardly with respect to the placing plane 18. In other words, the weight portion 16*c* operates to swivel the second lever member 16 in the counterclockwise direction in FIG. 13.

The first lever member 6 is biased in the counterclockwise direction in FIG. 13 by a torsion coil spring 9 which is one example of the second biasing unit 8 installed at the first lever shaft 6*a*.

The size of the acting force generated by the weight portion 16*c* serving as the first biasing unit 17, and the size of the biasing force of the torsion coil spring 9 serving as the second biasing unit 8 will be described.

The size of the acting force generated by the weight portion 16*c* serving as the first biasing unit 17 is not against the weight of the one sheet of paper P, but is set to maintain the projection portion 16*b* in the third state under a condition in which the external force does not act.

Similarly, the size of the biasing force of the torsion coil spring 9 serving as the second biasing unit 8 is not against the weight of the one sheet of paper P, but is set to maintain the displacement member 5 in the first state under a condition in which the external force does not act.

In addition, the size of the biasing force of the torsion coil spring 9 serving as the second biasing unit 8 is set to be larger than the size of the acting force generated by the weight portion 16*c* serving as the first biasing unit 17.

Accordingly, as shown in FIG. 13, in the state in which the paper P is not placed on the placing plane 18, the posture of the first lever member 6 pushes up the second engaging portion 16*e* of the second lever member 16 in the first engaging portion 6*b*, and thus the first abutting portion 6*c* comes into contact with the first restriction portion 19 below the placing surface 18. That is, the posture of the first lever member 6 is determined by contact between the first abutting portion 6*c* and the first restriction portion 19.

With the posture of the second lever member 16, the weight portion 16*c* serving as the first biasing unit 17 acts, but the second engaging portion 16*e* is pushed up against the first engaging portion 6*b* of the first lever member 6 according to a magnitude relation between the above-described biasing force and the acting force. That is, the posture of the second lever member 16 is determined by contact between the second engaging portion 16*e* and the first engaging portion 6*b*. In this instance, the second abutting portion 16*d* is spaced slightly apart from the second restriction portion 24 below the placing surface 18.

In the state shown in FIG. 13, the first engaging portion 6*b* comes into contact with the second engaging portion 16*e*, but is not firmly engaged with each other.

As shown in FIG. 14, in the state in which the paper P is placed on the placing plane 18, the displacement member 5 and the projection portion 16*b* are pushed downwardly in the stacked direction by the weight of the paper P.

As shown in FIG. 13, in the first state of the displacement member 5 and the third state of the projection portion 16*b*, the top portion which is the upper end of the projection portion 16*b* in the stacked direction is positioned at a higher position in the stacked direction than the edge 7 which is the upper end of the displacement member 5 in the stacked direction. When the paper P is placed, the projection portion 16*b* comes into contact with the rear surface of the paper P at a faster timing than the displacement member 5.

Accordingly, the second lever member 16 starts to swivel in the clockwise direction in FIG. 14 at a faster timing than the first lever member 6. That is, the second engaging portion 16*e* starts to swivel in the clockwise direction at faster timing than the first engaging portion 6*b*. In this instance, the second engaging portion 16*e* swivels to retract from the trace of the first engaging portion 6*b*. Therefore, the second engaging portion 16*e* does not disturb the swivel of the first engaging portion 6*b*. As a result, the displacement member 5 is pushed down by the weight of the paper P, so that it is in the second state in which the displacement member 5 retracts downwardly in the stacked direction with respect to the pad unit 15.

The upper end of the edge 7 of the displacement member 5 in the stacked direction retracts to the position approximately identical to the placing plane 18 in the stacked direction Z. The reason is that the top portion 15*a* of the pad unit 15 slightly protrudes upwardly in the stacked direction with respect to the placing plane 18. And, the reason is that, in addition to the portion of the paper P which is held by the pad unit 15, a portion of the paper P is bent by its own weight, and thus descends downwardly in the stacked direction with the portion supported by the pad unit 15.

Similarly, the projection portion 16*b* is pushed downwardly by the weight of the paper P, so that it is in the fourth state in which the top portion of the projection portion 16*b* retracts to the position approximately identical to the placing plane 18 in the stacked direction Z.

In this state, the placed paper P can reliably come into contact with the pad unit 15. Accordingly, when the paper P is fed by the pick-up roller 21, the above-described relationship of the frictional coefficients can be maintained. As a result, it is possible to stabilize the separation ability to separate the uppermost paper P1 from the second uppermost paper P2. If some sheets of the placed paper P are fed, only one sheet is finally placed.

Figure 15:
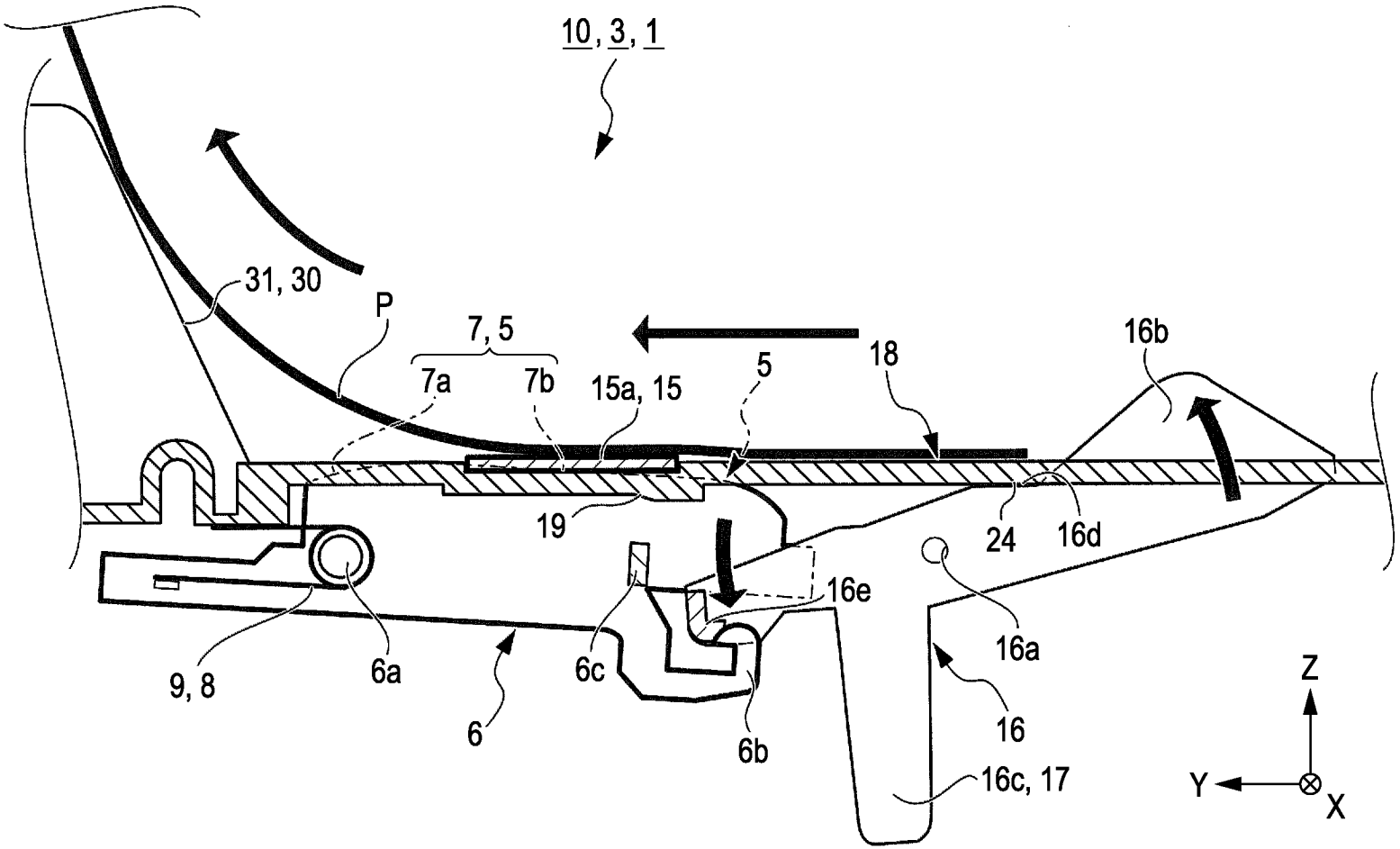
FIG. 15 is a cross-sectional view schematically illustrating a second state of a displacement member according to the invention (before a trailing end of paper passes).

FIG. 15 is a cross-sectional view schematically illustrating the state in which the final single sheet of paper is fed to the downstream side of the feeding direction. In this instance, the trailing end of the final paper passes through the projection portion, and the trailing end does not pass through the displacement member.

In this instance, in order to easily understand the state of the displacement member and the projection portion, the pick-up roller is not illustrated.

As shown in FIG. 15, the final single sheet of paper P is fed by the pick-up roller 21 to the downstream side of the feeding direction, and then the trailing end of the paper P passes through the projection portion 16*b*.

If so, the projection portion 16*b* is released from the weight of the paper P. That is, the weight of the paper P does no act on the projection portion 16*b*. Accordingly, the second lever member 16 swivels in the counterclockwise direction in the figure by the action of the weight portion 16*c* serving as the first biasing unit 17. The projection portion 16*b* is in the third state in which it protrudes upwardly in the stacked direction with respect to the placing plane 18 through the second slit 18*b*. In this instance, the second abutting portion 16*d* comes into contact with the second restriction portion 24, thereby stopping the swivel of the second lever member 16 in the counterclockwise direction.

Meanwhile, the second engaging portion 16*e* of the second lever member 16 opposite to the projection portion 16*b* on the basis of the second lever shaft 16*a* approaches the first engaging portion 6*b* of the first lever member 6. The second engaging portion 16*e* is not engaged with the first engaging portion 6*b*, then stops. The second engaging portion 16*e* may come into contact with the first engaging portion 6*b*, or may be spaced apart from the first engaging portion. If the first and second engaging portions are not firmly engaged with each other, any state is possible.

In this instance, since the paper P is placed on the displacement member, the weight of the paper P acts on the displacement member 5. Accordingly, the posture of the first lever member 6 is identical to the state shown in FIG. 14.

Figure 16:
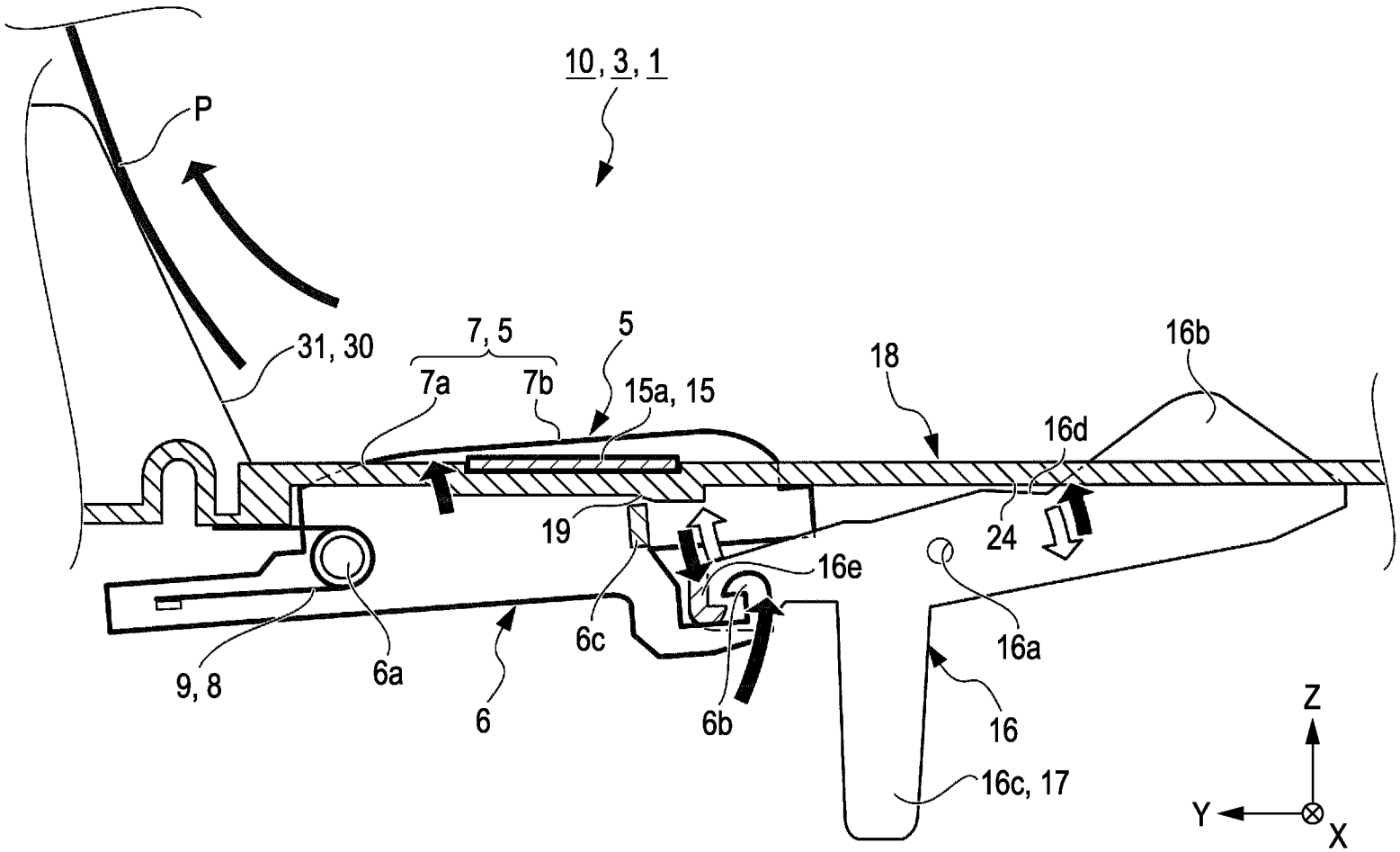
FIG. 16 is a cross-sectional view schematically illustrating a first state of a displacement member according to the invention (after a trailing end of paper passes).

FIG. 16 is a cross-sectional view schematically illustrating the state in which the final single sheet of paper is fed to the downstream side of the feeding direction. In this instance, the trailing end of the paper passes through the displacement member.

In this instance, in order to easily understand the state of the displacement member and the projection portion, the pick-up roller is not illustrated.

As shown in FIG. 16, the paper P is fed by the pick-up roller 21 and the pair of feed rollers 96 to the downstream side of the feeding direction, and then the trailing end of the paper P passes through the displacement member 5.

If so, the displacement member 5 is released from the weight of the paper P. That is, the weight of the paper P does no act on the displacement member 5. Accordingly, the first lever member 6 swivels in the counterclockwise direction in the figure by the biasing force of the torsion coil spring 9 serving as the second biasing unit 8. The displacement member 5 is in the first state in which it protrudes upwardly in the stacked direction with respect to the top portion 15*a* of the pad unit 15 through the first slit 18*a*.

In this instance, the first engaging portion 6*b* pushes up the second engaging portion 16*e* against the acting force of the weight portion 16*c*, by the above-described magnitude relationship between the biasing force and the acting force, to slightly swivel the second lever member 16 in the clockwise direction. The second engaging portion 16*e* is deviated from the trace of the first engaging portion 6*b*, so that the second engaging portion 16*e* is temporarily released from the push-up of the first engaging portion 6*b*. In this instance, the second lever member 16 swivels in the counterclockwise direction by the acting force of the weight portion 16*c*.

The second engaging portion side comes into contact with the first engaging portion side, thereby stopping the swivel of the second lever member 16 in the counterclockwise direction. In this instance, the swivel of the first lever member 6 in the counterclockwise direction is stopped by abutment of the first abutting portion 6*c* against the first restriction portion 19 at the time. That is, the posture of the first lever member 6 is determined by contact between the first abutting portion 6*c* and the first restriction portion 19.

Meanwhile, the projection portion 16*b* is in the third state in which it protrudes upwardly with respect to the placing plane 18. The posture of the second lever member 16 is determined by the contact between the first engaging portion 6*b* and the second engaging portion 16*e*. In this instance, the second abutting portion 16*d* is spaced slightly apart from the second restriction portion 24.

That is, it is similar to the above-described state in which the paper P is not placed on the placing plane 18 (FIG. 13).

Figure 17:
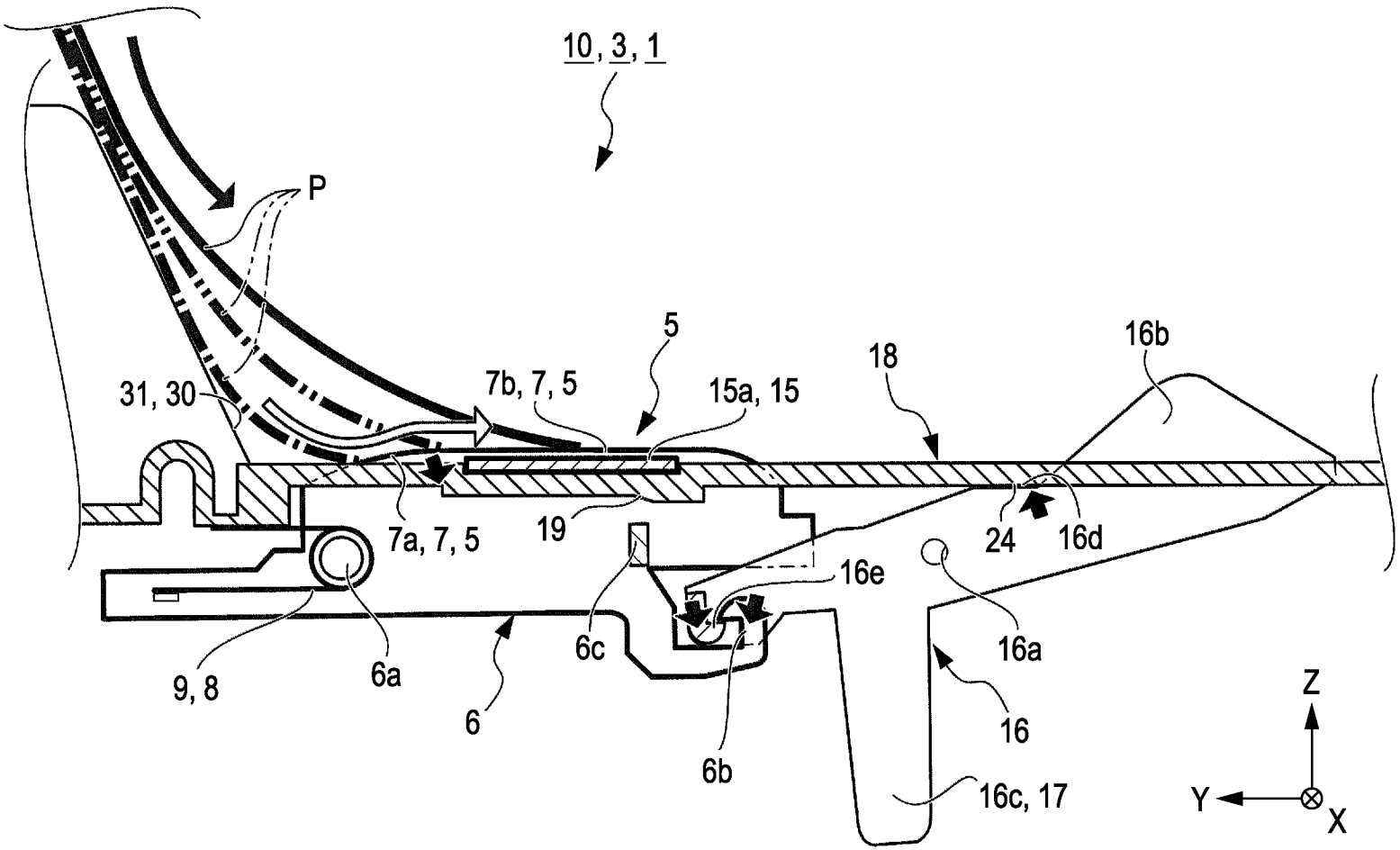
FIG. 17 is a cross-sectional view schematically illustrating a first state of a displacement member according to the invention (at the time of reverse feeding).

FIG. 17 is a cross-sectional view schematically illustrating the state in which the final single sheet of paper is fed to the downstream side of the feeding direction and then is reversely fed to the upstream side of the feeding direction.

In this instance, in order to easily understand the state of the displacement member and the projection portion, the pick-up roller is not illustrated.

As shown in FIG. 17, the case where the final single sheet of paper P is reversely fed is considered.

The mechanical significance of the reverse paper feed is to eliminate the deflection of the paper P which occurs between the pair of feed rollers 96 and the pair of transport rollers 71, for example, when the skew removal operation of the paper P is executed, as described above. In this instance, as described above, the second assist roller 51 is spaced apart from the intermediate driving roller 50 to drive the intermediate driving roller 50 in the reverse rotation. Accordingly, the trailing side of the paper P can be reversely fed to the upstream of the feeding direction when recording. In this instance, the trailing end of the paper P is fed to the upstream of the feeding direction when recording.

Herein, the posture of the reversely fad paper P is indicated by a thick one-dotted line, in the state in which the trailing end of the paper P is positioned at the downstream side of the feeding direction rather than the displacement member 5 when recording. In addition, a thick double-dotted line indicates a state in which the paper is further reversely fed from the state indicated by the thick one-dotted line, and the trailing end of the paper P comes into contact with the displacement member 5 at the downstream side of the feeding direction rather than the pad unit 15 when recording. In addition, a thick solid line indicates a state in which the paper is further reversely fed from the state indicated by the thick double-dotted line, and then the trailing end of the paper P is positioned upwardly in the stacked direction with respect to the pad unit 15, with the trailing end coming into contact with the displacement member 5.

In a case where the final single sheet of paper P is reversely fed, the trailing end of the paper P having a specific size is positioned at a position adjacent to the pad unit in the feeding direction Y along the distance of the feed path. In this instance, as described above, the trailing end of the final single sheet of paper P passes through the displacement member 5, so that the displacement member 5 is in the first state and the projection portion 16*b* is in the third state. If the trailing end side of the final single sheet of paper P is reversely fed, the trailing end of the paper P comes into contact with the placing plane 18 and thus is guided by the placing plane 18, as indicated by the thick one-dotted line, so that the paper moves to the upstream of the feeding direction when recording.

If the paper is reversely fed, the trailing end of the paper P moves as though climbing the slope portion 7*a* of the edge 7 of the displacement member 5, and then is guided to the flat portion 7*b*. In this instance, the weight of the paper P acts on the displacement member 5. Therefore, the first lever member 6 tries to swivel in the clockwise direction. When the first lever member 6 slightly swivels in the clockwise direction, the first engaging portion 6*b* is engaged with the second engaging portion 16*e* of the second level member 16. With the engagement, the second lever member 16 is applied by the force to swivel the second lever member 16 in the counterclockwise direction.

When the second lever member 16 slightly swivels in the counterclockwise direction, the second abutting portion 16*d* abuts against the second restriction portion 24 to stop the swivel of the second lever member 16 in the counterclockwise direction. Accordingly, the swivel of the first lever member 6 in the clockwise direction is stopped by the engagement of the first engaging portion 6*b* and the second engaging portion 16*e*. That is, the first engaging portion 6*b* and the second engaging portion 16*e* are firmly engaged with each other to maintain the posture of the first lever member 6.

In other words, the second lever member 16 locks the posture of the first lever member 6. In this instance, the posture of the flat portion 7*b* of the edge 7 of the displacement member 5 is almost parallel with the posture of the top portion 15*a* of the pad unit 15.

In this instance, the displacement member 5 is in the first state in which it protrudes upwardly in the stacked direction with respect to the pad unit 15 installed on the placing plane 18.

If the paper is further reversely fed, the trailing end of the paper. P is guided to the flat portion 7*b* of the edge 7 of the displacement member 5. Herein, the flat portion 7*b* is positioned higher than the top portion 15*a* of the pad unit 15 in the stacked direction Z. Accordingly, the trailing end of the paper P is not caught by the downstream end of the pad unit 15 in the feeding direction when recording. That is, the edge 7 of the displacement member 5 guides the paper in such a way that the trailing end of the paper P rises, thereby jumping over the stepped portion which is formed by the downstream end of the pad unit 15 and the placing plane 18. In addition, if the paper is further reversely fed, it is possible to prevent the trailing end of the paper P from coming into contact with the pad unit 15.

In this instance, when the paper is reversely fed, the trailing end of the paper P does not come into contact with the projection portion 16*b* of the second lever member 16.

In the case where the final single sheet of paper is fed together with a sheet of paper, which is second to the final sheet, due to a double paper feed, the final single sheet of paper is separated by any one of the preliminary separation unit 30, the main separation unit 40 and the paper leading-end restricting rib 60.

In this instance, the trailing end of the final single sheet of paper does not pass through the pad unit 15. That is, in the case where the final single sheet of paper is doubly fed, the second lever member 16 dose not lock the posture of the first lever member 6. In addition, if it is locked, the final single sheet of paper is pressed by the pick-up roller 21, and thus the projection portion 16*b* is pressed downwardly in the stacked direction, so that the posture of the first lever member 6 is unlocked.

As described above, even in the case where the trailing end side of the final single sheet of paper P is reversely fed, the trailing end is not caught by the stepped portion between the placing plane 18 and the pad unit 15. In addition, the trailing end side of the paper P does not come into contact with the top portion 15*a* of the pad unit 15 to receive the frictional resistance. That is, the reverse feed of the trailing end side of the paper P is not disturbed. As a result, it is possible to reliably eliminate the deflection between the pair of the feed rollers 96 and the pairs of transport rollers 71 which is produced at the time of the skew removal operation. In addition, it is possible to stabilize the transport precision.

In this embodiment, the displacement member 5 is installed at the first lever member 6 and is configured to swivel, but it is not limited to a swivel. A configuration which moves up and down in the stacked direction is possible. In addition, the projection portion 16*b* is similar to the displacement member. The projection portion 16*b* which moves up and down in the stacked direction is possible. In addition, the weight portion 16*c* is provided as one example of the first biasing unit 17, but a spring or the like may be employed. In addition, the torsion coil spring 9 is used as one example of the second biasing unit 8, but other kinds of springs or weight may be used.

The pad unit 15 made of cork material is used as one example of the friction member, but the material may be substituted by any material which meets the above-described relationship of the frictional coefficients. Moreover, a configuration is possible, in which the top portion 15*a* of the pad unit 15 does not protrude upwardly in the stacked direction with respect to the placing plane 18. In such a case, when the paper is reversely fed, the trailing end of the paper P is not caught by the stepped portion, but the paper P comes into contact with the top portion 15*a* of the pad unit 15 so that the reverse feed may be disturbed.

In addition, although the first lever member 6 swivels by the weight of the paper P to convert the first state and the second state of the displacement member 5 in this embodiment, it is not limited thereto. A configuration is possible, in which the trailing end of the final paper P passing through the displacement member 5 is detected by the second paper detector 28, and the displacement member 5 is converted between the first state and the second state by any unit, such as cam mechanism, which is driven by the power from a motor or the like.

Moreover, in this embodiment, although, in the fourth state of the projection portion 16*b*, the top portion of the projection portion 16*b* is flush with the placing plane 18 in the stacked direction Z, it is not limited to the same position. If the projection portion is located at the position lower than the third state, it is possible. The reason is that if the projection portion is located at the position lower than the third state, it can be judged that the paper P comes into contact with the projection 16*b*.

In addition, in this embodiment, although the displacement members 5 and 5 are installed at both sides of the pad unit 15 in the widthwise direction X, it is not limited thereto. The displacement members may be installed at the downstream side of the pad unit 15 in the feeding direction Y. In such a case, when the final single sheet of paper is reversely fed, it is possible to prevent the trailing end of the paper from coming into contact with the pad unit 15 and to prevent the paper from being caught by the stepped portion formed by the placing plane 18 and the pad unit 15.

The feed section 10 serving as the medium feeding device according to the embodiment is characterized by including the placing plane 18 on which the paper P, one example of a medium to be fed, is placed; the pick-up roller 21 serving as the first feeding unit to feed the paper P placed on the placing plane 18 to the downstream side of the feeding direction; the intermediate driving roller 50 serving as the second feeding unit to feed the paper P fed by the pick-up roller 21 to the upstream side and downstream side of the feeding direction on the basis of the feeding direction Y of the pick-up roller 21; the pad unit 15 made of cork material and serving as the friction member installed at the position of the placing plane 18 opposite to the pick-up roller 21; and the displacement member 5 installed adjacent to the pad unit 15 and converted between the first state in which the displacement member protrudes upwardly in the stacked direction of the paper P with respect to the pad unit 15 and the second state in which the displacement member retracts downwardly in the stacked direction with respect to the pad unit 15, wherein the displacement member 5 is set as the second state when one remaining sheet of paper P placed on the placing plane 18 is fed to the downstream side of the feeding direction by the pick-up roller 21, and the displacement member 5 is set as the first state when the tailing end, which is the upper end thereof in the feeding direction, of the one remaining sheet of paper P in the feeding direction passes through the pad unit 15 and then the paper P is reversely fed to the upstream side of the feeding direction by the intermediate driving roller 50.

In addition, in this embodiment, the pad unit 15 is characterized by protruding upwardly in the stacked direction of the paper P with respect to the placing plane 18.

In this embodiment, the feed unit is characterized by further including the first lever member 6 serving as the first arm section having the displacement member 5; the second lever member 16 serving as the second arm section and being able to engage with the first lever member 6; and the projection portion 16*b* installed at the second lever member 16 and converted between the third state in which the projection portion protrudes from the placing plane 18 and the fourth state in which the projection portion retracts downwardly in the stacked direction with respect to the third state, wherein the projection portion 16*b* is biased by the weight of the weight portion 16*c* which is one example of the first biasing unit 17 so that the projection portion is in the third state if an external force is not applied, and is in the fourth state by the weight of one sheet of paper P on the projection portion; in the fourth state of the projection portion 16*b*, the engagement of the second lever member 16 and the first lever member 6 is released; in the state in which the engagement of the second lever member 16 and the first lever member 6 is released, the displacement member 5 is biased by a spring force of the torsion coil spring 9, which is one example of the second biasing unit 8, so that the displacement member is in the first state if the external force is not applied to the displacement member 5 and the projection portion 16*b*, and is in the second state by the weight of one sheet of paper P on the displacement member; the biasing force generated from the torsion coil spring 9 is higher than the biasing force generated from the weight portion 16*c*, and the first lever member 6 is engaged with the second lever member 16 when the second state is converted into the first state; and if the projection portion 16*b* is in the third state, the second lever member 16 is engaged with the first lever member 6 to maintain the first state of the displacement member 5.

In this embodiment, the edge 7 of the displacement member 5 which is positioned at the upward side of the stacked direction in the feeding direction Y extends from the upstream side rather than the upstream end of the top portion 15*a* of the pad unit 15 in the feeding direction to the downstream side rather than the downstream end of the top portion 15*a* of the pad unit 15 in the feeding direction, and the edge 7 is provided with the slope portion 7*a* which is inclined with respect to the placing surface 18, at the downstream side rather than the downstream end of the top portion 15*a* of the pad unit 15, in such a way that the downstream end of the top portion 15*a* of the pad unit 15 is positioned downward in the stacked direction with respect to the placing plane 18 in the first state and is positioned upward in the stacked direction with respect to the top portion 15*a* as proceeding to the upstream side.

In this embodiment, the feed unit is characterized in that the edge 7 is provided with the flat portion 7*b* at the upstream side thereof rather than the slope portion 7*a*; when the displacement member 5 is in the first state or the projection portion 16*b* is in the third state, and no paper P is on the displacement member of the first state, the posture of the flat portion 7*b* at the edge 7 of the displacement member 5 is slanted with respect to the top portion 15*a* of the pad unit 15 so that the upstream side of the flat portion 7*b* is upward in the stacked direction rather than the downstream side; and when the paper P is reversely fed by the intermediate driving roller 50 and is moved onto the displacement member of the first state, and when the first lever member 6 is displaced by the weight of the paper P, the second lever member 16 restricts the displacement of the first lever member 6 which is more than a predetermined amount, and at that time, the posture of the flat portion 7*b* of the edge 7 follows the posture of the top portion 15*a* of the pad unit 15.

The printer 1 serving as the recording apparatus according to the embodiment is characterized by including the feed section 10 serving as the medium feeding unit to feed the paper P, which is one example of the recorded medium, to the downstream side of the feeding direction, and the recording unit 80 recording the paper P fed by the feed section 10 by the recording head 82.

The invention is not limited to the above-described embodiment. It is, of course, to be understood that various modifications may be made within the scope of the following claims, and the invention encompasses the modifications.

This application is a Continuation of application Ser. No. 12/900,275, filed Oct. 7, 2010, which is expressly incorporated herein by reference. The entire disclosure of Japanese Patent Application No. 2009-234083, filed Oct. 8, 2009 is expressly incorporated by reference herein.

What is claimed is:

1. A medium feeding device comprising:

a placing unit on which a medium is placed; and a feeding unit which feeds the medium in a first direction and a second direction which opposite the first direction, wherein the placing unit includes a friction member, and a supporting unit which is able to support the medium, at least a part of the supporting unit is located above the friction member when the medium is fed in the second direction.

2. The medium feeding device according to claim 1, wherein when the medium is fed in the second direction, at least the part of the supporting unit is located above a position of the supporting unit when the medium is fed in the first direction and the medium is placed on the friction member.

3. The medium feeding device according to claim 1, wherein the placing unit includes a placing plane on which the medium is placed, wherein the friction member is installed above the placing plane.

4. The medium feeding device according to claim 1, wherein a plurality of the friction member are located in a direction which intersects the first direction, wherein the supporting unit is installed between the plurality of the friction member in the direction which intersects the first direction.

5. The medium feeding device according to claim 1, wherein the supporting unit includes a first arm unit which at least a part of the first arm unit is able to be located above the friction member, a second arm unit which is able to be engaged with the first arm unit, and a holding unit which holds a state that at least the part of the first arm unit is located above the friction unit when the second arm unit is engaged with the first arm unit.

6. The medium feeding device according to claim 5, wherein the first arm unit is able to be located below the friction member and an engagement of the first arm unit and the second arm unit is released when the first arm unit is located below the friction member.

7. The medium feeding device according to claim 5, wherein the second arm unit which at least a part of the second arm unit is able to be located above the friction member, at least the part of the second arm unit is engaged with the first arm unit when the first arm unit and the second arm unit are located above the friction member.

8. A medium feeding device comprising:

a placing unit on which a medium is placed; and a feeding unit which feeds the medium, wherein the placing unit includes a friction member, a first arm unit which is able to support the medium, at least a part of the first arm unit is able to be located above the friction member, a second arm unit which is able to be engaged with the first arm unit, and a holding unit which holds a state that at least the part of the first arm unit is located above the friction unit when the second arm unit is engaged with the first arm unit.

9. The medium feeding device according to claim 8, wherein the first arm unit is able to be located below the friction member and an engagement of the first arm unit and the second arm unit is released when the first arm unit is located below the friction member.

10. The medium feeding device according to claim 8, wherein at least a part of the second arm unit is able to be located above the friction member, the second arm unit is engaged with the first arm unit when at least the part of the first arm unit and at least the part of the second arm unit are located above the friction member.

11. The medium feeding device according to claim 8, wherein a plurality of the friction member are located in a direction which intersects the first direction, wherein the supporting unit is installed between the plurality of the friction member in the direction which intersects the first direction.

12. A recording apparatus comprising:

a recording unit which performs recording on the medium;

a placing unit on which a medium is placed; and a feeding unit which feeds the medium in a first direction and a second direction which opposite the first direction, wherein the placing unit includes a friction member, and a supporting unit which is able to support the medium, at least a part of the supporting unit is located above the friction member when the medium is fed in the second direction.

13. The recording apparatus according to claim 12, wherein when the medium is fed in the second direction, at least the part of the supporting unit is located above a position of the supporting unit when the medium is fed in the first direction.

14. The recording apparatus according to claim 12, wherein the placing unit includes a placing plane on which the medium is placed, wherein the friction member is installed above the placing plane.

15. The recording apparatus according to claim 12, wherein a plurality of the friction member are located in a direction which intersects the first direction, wherein the supporting unit is installed between the plurality of the friction member in the direction which intersects the first direction.

16. The recording apparatus according to claim 12, wherein the supporting unit includes a first arm unit which at least a part of the first arm unit is able to be located above the friction member, a second arm unit which is able to be engaged with the first arm unit, and a holding unit which holds a state that at least the part of the first arm unit is located above the friction unit when the second arm unit is engaged with the first arm unit.

17. The recording apparatus according to claim 12, wherein the first arm unit is able to be located below the friction member and an engagement of the first arm unit and the second arm unit is released when the first arm unit is located below the friction member.

18. A recording apparatus comprising:

a recording unit which performs recording on the medium;

a placing unit on which a medium is placed; and a feeding unit which feeds the medium, wherein the placing unit includes a friction member, a first arm unit which is able to support the medium, at least a part of the first arm unit is able to be located above the friction member, a second arm unit which is able to be engaged with the first arm unit, and a holding unit which holds a state that at least a part of the first arm unit is located above the friction unit when the second arm unit is engaged with the first arm unit.

19. The recording apparatus according to claim 18, wherein a plurality of the friction member are located in a direction which intersects the first direction, wherein the supporting unit is installed between the plurality of the friction member in the direction which intersects the first direction.

* * * * *